US006350553B2

(12) United States Patent
Srinivasan

(10) Patent No.: US 6,350,553 B2
(45) Date of Patent: Feb. 26, 2002

(54) ELECTROPHOTOGRAPHIC PHOTOCONDUCTORS COMPRISING POLYARYL ETHERS

(75) Inventor: Kasturi R. Srinivasan, Longmont, CO (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/766,997

(22) Filed: Jan. 23, 2001

Related U.S. Application Data

(62) Division of application No. 09/480,026, filed on Jan. 10, 2000, now Pat. No. 6,232,025.

(51) Int. Cl.[7] ..... G03G 5/047

(52) U.S. Cl. ..... 430/135; 430/58.4; 430/58.35; 430/59.6; 430/96

(58) Field of Search ..... 430/135, 58.4, 430/58.35, 59.6, 96

(56) References Cited

U.S. PATENT DOCUMENTS

| | | | | | |
|---|---|---|---|---|---|
| 4,419,486 | A | | 12/1983 | Rose | 525/534 |
| 4,657,990 | A | | 4/1987 | Daoust et al. | 525/471 |
| 4,728,561 | A | * | 3/1988 | Crocker | 428/207 |
| 4,772,526 | A | | 9/1988 | Kan et al. | 430/96 |
| 4,861,856 | A | * | 8/1989 | Darnell et al. | 528/125 |
| 4,882,397 | A | | 11/1989 | Kelsey | 525/471 |
| 4,970,284 | A | * | 11/1990 | Staniland et al. | 528/125 |
| 4,990,589 | A | | 2/1991 | Towle et al. | 528/125 |
| 5,006,443 | A | | 4/1991 | Müller | 430/96 |
| 5,073,466 | A | | 12/1991 | Ishikawa et al. | 430/66 |
| 5,130,215 | A | | 7/1992 | Adley et al. | 430/66 |
| 5,288,834 | A | | 2/1994 | Roovers et al. | 528/125 |
| 5,322,755 | A | | 6/1994 | Allen et al. | 430/96 |
| 5,344,733 | A | | 9/1994 | Suzuki et al. | 430/96 |
| 5,545,499 | A | | 8/1996 | Balthis et al. | 430/96 |
| 5,725,982 | A | | 3/1998 | Nogami et al. | 430/66 |
| 5,837,410 | A | | 11/1998 | Nakamura et al. | 430/130 |
| 6,042,980 | A | * | 3/2000 | Keirstein et al. | 430/96 |

FOREIGN PATENT DOCUMENTS

| | | |
|---|---|---|
| EP | 0501455 A1 | 2/1992 |
| JP | 63 70256 | 3/1988 |
| JP | 63 239454 | 10/1988 |
| JP | 63 247757 | 10/1988 |

OTHER PUBLICATIONS

Irvin, Jennifer A. et al., *Polyethers Derived from Bisphenols and Highly Fluorinated Aromatics*, Journal of Polymer Science: Part A: Polymer Chemistry, vol. 30, pp. 1675–1679 (1992).

Mercer, Frank et al., *Low Dielectric Constant Fluorinated Aryl Ethers Prepared From Decafluorobiphenyl*, Corporate Research and Development, Raychem Corporation, Menlo Park, CA.

* cited by examiner

*Primary Examiner*—Mark Chapman
(74) *Attorney, Agent, or Firm*—John J. McArdle, Jr.; John A. Brady

(57) ABSTRACT

A photoconductor comprises a substrate and at least one layer. The at least one layer is selected from the group consisting of charge transfer layers comprising a charge transfer molecule, polycarbonate and a first polyaryl ether selected from the group consisting of polyaryletherketones, poly(aryl-perfluoroaryl ether)s, polyaryletherketone-hydrazones, polyaryletherketone-azines and mixtures and copolymers thereof; charge generating layers comprising a pigment, a polyvinylbutyral and a second polyaryl ether selected from the group consisting of polyaryletherketones, polyarylethersulfones and mixtures and copolymers thereof; and mixtures thereof.

9 Claims, No Drawings

ELECTROPHOTOGRAPHIC PHOTOCONDUCTORS COMPRISING POLYARYL ETHERS

CROSS-REFERENCE TO RELATED APPLICATION

This application is a division of U.S. application Ser. No. 09/480,026; filed Jan. 10, 2000, now U.S. Pat. No. 6,232,025.

FIELD OF INVENTION

The present invention is directed toward photoconductors and compositions used to form photoconductors. More particularly, the invention is directed toward photoconductors comprising a substrate and a layer selected from the group consisting of charge transfer layers comprising a charge transfer molecule, polycarbonate and a first polyaryl ether; charge generating layers comprising a pigment, polyvinylbutyral and a second polyaryl ether; and mixtures thereof. The invention is also directed toward methods of improving the electrical characteristics of photoconductors, methods of extending the pot-life of charge transport compositions, and compositions used to form charge transport layers and charge generation layers.

BACKGROUND OF THE INVENTION

In electrophotography, a latent image is created on the surface of an imaging member such as a photoconducting material by first uniformly charging the surface and then selectively exposing areas of the surface to light. A difference in electrostatic charge density is created between those areas on the surface which are exposed to light and those areas on the surface which are not exposed to light. The latent electrostatic image is developed into a visible image by electrostatic toners. The toners are selectively attracted to either the exposed or unexposed portions of the photoconductor surface, depending on the relative electrostatic charges on the photoconductor surface, the development electrode and the toner.

Typically, a dual layer electrophotographic photoconductor comprises a substrate such as a metal ground plane member on which a charge generation layer (CGL) and a charge transport layer (CTL) are coated. The charge transport layer contains a charge transport material which comprises a hole transport material or an electron transport material. For simplicity, the following discussions herein are directed to use of a charge transport layer which comprises a hole transport material as the charge transport compound. One skilled in the art will appreciate that if the charge transport layer contains an electron transport material rather than a hole transport material, the charge placed on a photoconductor surface will be opposite that described herein.

When the charge transport layer containing a hole transport material is formed on the charge generation layer, a negative charge is typically placed on the photoconductor surface. Conversely, when the charge generation layer is formed on the charge transport layer, a positive charge is typically placed on the photoconductor surface. Conventionally, the charge generation layer comprises the charge generation compound or molecule, for example a squaraine pigment, a phthalocyanine, or an azo compound, alone or in combination with a binder. The charge transport layer typically comprises a polymeric binder containing the charge transport compound or molecule. The charge generation compounds within the charge generation layer are sensitive to image-forming radiation and photogenerate electron-hole pairs therein as a result of absorbing such radiation. The charge transport layer is usually non-absorbent of the image-forming radiation and the charge transport compounds serve to transport holes to the surface of a negatively charged photoconductor. Photoconductors of this type are disclosed in the Adley et al U.S. Pat. No. 5,130,215 and the Balthis et al U.S. Pat. No. 5,545,499.

Allen et al., U.S. Pat. No. 5,322,755, teach a layered polyconductive imaging member comprising a substrate, a photogenerator layer and a charge transport layer. Allen et al. teach the photogenerator layer comprises a binder mixture of two or more polymers such as polyvinylcarbazole, polycarbonates, polyvinylbutyral and polyesters.

Nogami et al., U.S. Pat. No. 5,725,982, teach photoconductors comprising a charge transport layer comprising an aromatic polycarbonate resin. Nogami et al. further teach the photoconductor may comprise a charge generating layer comprising resins such as polycarbonate resin, polyvinylbutyral, polyacrylic ester, polymethacrylic ester, vinylchloride based copolymer, polyvinylacetal, polyvinylpropional, phenoxy resin, epoxy resin, urethane resin, cellulose ester and cellulose ether.

Nakamura et al., U.S. Pat. No. 5,837,410, teach a photoconductor comprising a conductive layer and an organic film. Nakamura et al. teach that the organic film may comprise a charge-generating layer which comprises binders such as polyvinylbutyral resin, polyvinylchloride copolymer resin, acrylic resin, polyester resin and polycarbonate resin and a charge transport layer comprising resins such as polyester resin, polycarbonate resin, polymethacrylic resin and polystyrene resin.

Polyarylether ketones can be synthesized in art recognized ways, such as the method taught by Kelsey, U.S. Pat. No. 4,882,397, Rose, U.S. Pat. No. 4,419,486, and Roovers et al., U.S. Pat. No. 5,288,834. Kelsey teaches a process for preparing polyarylether ketones from a polyketal. Rose teaches sulfonation of polyarylether ketones. Roovers et al. teach bromomethyl derivatives of polyarylether ketones are useful intermediates for further functionalizing the aromatic polyether ketones, and further teach functionalized polyarylether ketones such as carbonyl fluoride poly (aryl ether ether ketone), cyan methylene poly(aryl ether ether ketone), diethylamine methylene poly(aryl ether ether ketone), and aldehyde polyaryl (aryl ether ether ketone).

Nakamura et al., EP 0501455 A1, teach a photoconductor comprising a substrate and a photosensitive layer comprising a charge generating layer and a charge transporting layer. Nakamura et al. teach the charge generating layer contains an organic pigment and a polyarylether ketone binder resin.

Japanese Patent Application JP 63239454 A teaches an electrophotographic sensitive body comprising a layer containing a polyetherketone binder resin, while Japanese Patent Application JP 632247754 A teaches an electrophotographic sensitive body comprising a charge transfer layer comprising a hydrazone compound charge transfer material and a polyetherketone resin. Japanese Application JP 63070256 A teaches a photoconductive layer comprising a polyetherketone resin laminated on a conductive base.

Kan et al., U.S. Pat. No. 4,772,526, disclose a reusable electrophotographic imaging element having a photoconductive surface layer in which the binder resin comprises a block copolyester or copolycarbonate having a fluorinated polyether block. Kan et al. teach that the surface layer is either capable of generating an injecting charge carriers upon exposure, or capable of accepting and transporting injected charge carriers.

Müller, U.S. Pat. No. 5,006,443, discloses perfluoralkyl group-containing polymers which are useful in radiation-sensitive reproduction layers. Müller teaches the perfluoroalkyl group-containing polymers comprise polymers or polycondensates and have phenolic hydroxyl groups and perfluoroalkyl groups which are optionally attached through intermediate members.

Ishikawa et al., U.S. Pat. No. 5,073,466, disclose an electrophotographic member comprising a support, a photoconductive layer, and a surface layer comprising a lubricating agent and a fixing group. Ishikawa et al. teach the lubricating agent has a perfluoropolyoxyalkyl group or a perfluoropolyoxyalkylene group.

Suzuki, et al., U.S. Pat. No. 5,344,733, disclose an electrophotographic receptor having an overcoat layer on the surface of a photosensitive layer containing a charge generating substance. Suzuki et al. teach the overcoat layer comprises a fluororesin cured with a melamine compound or an isocyanate compound as a cross-linking agent, a charge generating substance, and a charge transport substance.

The charge transport layer and charge generation layers of photoconductors generally comprise binders. For example, the charge generation layer generally comprises pigments, however, since pigments do not adhere effectively to metal substrates, polymer binders are usually included. Unfortunately, the electrical sensitivity of the charge generation layer, drum wear, or composition pot-life can be affected by the polymer binder.

For example, the use of polyvinylbutyral as a charge generation layer binder is advantageous in that it significantly improves adhesion of the charge generation layer to the substrate. Unfortunately, polyvinylbutyral can disadvantageously affect electrical characteristics of the resulting photoconductor in causing, inter alia, high dark decay and residual voltage properties.

Polycarbonates have been known to improve the mechanical properties of a photoconductor, particularly its impact resistance. Unfortunately, the use of polycarbonates can result in photoconductors which are susceptible to drum-end wear, which may result in print-quality defects or drum failure, and to scratches in the paper area, which may lead to print-quality defects.

The use of polytetrafluoroethylene results in photoconductor drums exhibiting lower coefficients of friction and higher abrasion resistance. Unfortunately, polytetrafluoroethylene tends to settle in the transport composition, therefore adversely affecting the pot-life of the composition.

SUMMARY OF THE INVENTION

Accordingly, it is an object of this invention to obviate various problems of the prior art.

It is another object of this invention to provide photoconductors having good electrical characteristics, particularly electrical sensitivity, and reduced dark decay.

It is a further object of this invention to provide photoconductors which have improved print-stability and fatigue characteristics.

It is another object of this invention to provide charge transport compositions having extended pot-life.

It is an object of this invention to provide photoconductors exhibiting low electrical fatigue and stable print-performance.

In accordance with one aspect of the invention there are provided photoconductors comprising a substrate and at least one layer selected from the group consisting of:

a) charge transfer layers comprising a charge transfer molecule, polycarbonate and a first polyaryl ether selected from the group consisting of polyaryletherketones, poly(aryl-perfluoroaryl ether)s, polyaryletherketone-hydrazones, polyaryletherketone-azines and mixtures and copolymers thereof;

b) charge generation layers comprising a pigment, polyvinylbutyral and a second polyaryl ether selected from the group consisting of polyaryletherketones, polyarylethersulfones and mixtures and copolymers thereof; and c) mixtures thereof.

In accordance with another aspect of the invention there is provided methods of improving one or more electrical characteristics of photoconductors. The methods comprise the step of forming photoconductors comprising a substrate and at least one layer selected from the group consisting of:

a) charge transfer layers comprising a charge transfer molecule, polycarbonate and a first polyaryl ether selected from the group consisting of polyaryletherketones, poly(aryl-perfluoroaryl ether)s, polyaryletherketone-hydrazones, polyaryletherketone-azines and mixtures thereof;

b) charge generating layers comprising a pigment, a polyvinylbutyral and a second polyaryl ether selected from the group consisting of polyaryletherketones, polyarylethersulfones and mixtures thereof; and c) mixtures thereof.

When the photoconductor comprises a charge transfer layer comprising a polyarylether ketone, the weight ratio of polycarbonate to polyarylether ketone is preferably from about 93:7 to about 86:14.

In accordance with another aspect of the invention there are provided methods of extending the pot-life of a charge transport composition. The methods comprise the step of providing polyaryl ethers selected from the group consisting of polyaryletherketones, poly(aryl-perfluoroaryl ether)s, polyaryletherketone-hydrazones, polyaryletherketone-azines and mixtures thereof in combination with polycarbonate and a charge transport molecule.

In accordance with a further aspect of the invention there are provided charge transfer compositions comprising a charge transfer molecule, solvent and a binder blend. The binder blend comprises polycarbonate and a polyaryl ether selected from the group consisting of polyaryletherketones, poly(aryl-perfluoroaryl ether)s, polyaryletherketone-hydrazones, polyaryletherketone-azines and mixtures thereof.

In accordance with yet another aspect of the invention there are provided charge generation compositions comprising pigment, solvent and a binder blend. The binder blend comprises polyvinylbutyral and a polyaryl ether selected from the group consisting of polyaryletherketones, polyarylethersulfones and mixtures thereof.

In accordance with yet another aspect of the invention there are provided methods of preparing modified polyaryletherketones comprising the step of condensing polyaryletherketones with a reagent selected from the group consisting of hydrazines and hydrazones.

It has been found that photoconductors in accordance with the present invention have good electrical characteristics, low electrical fatigue and stable print-performance. Further, it has been found that charge transport compositions in accordance with the present invention have improved extended pot-life.

These and additional objects and advantages will be more fully apparent in view of the following description.

DETAILED DESCRIPTION

The charge transport and charge generation layers according to the present invention are suitable for use in dual layer photoconductors. Such photoconductors generally comprise a substrate, a charge generation layer (CGL) and a charge transport layer (CTL). The photoconductors may also comprise a sub-layer to assist in the adhesion of the charge generation and charge transport layers, or a protective coating to reinforce the durability of the charge generation and charge transport layers. Some substrates, such as aluminum, may be anodized.

While various embodiments of the invention discussed herein refer to the charge generation layer as being formed on the substrate, with the charge transport layer formed on the charge generation layer, it is equally within the scope of the present invention for the charge transport layer to be formed on the substrate with the charge generation layer formed on the charge transport layer.

The present invention is directed toward photoconductors, and more particularly to photoconductors comprising charge transport layers and/or charge generation layers comprising binder blends containing a polyaryl ether. Photoconductors comprising charge generation layers and/or charge transfer layers in accordance with the present invention exhibit improved electrical characteristics such as improved photosensitivity, reduced dark decay, and reduced fatigue.

As used herein, "cardo groups" refers to cyclic groups that tend to form a loop in the polymer chain. Cardo groups include cyclohexyl, fluorenyl and phthalidenyl groups.

As used herein, "charge voltage" refers to the voltage applied on a drum by a charge roll or corona. "Discharge voltage" refers to the voltage on the drum after shining light on the drum. Discharge voltage may be measured at several different light energies. Whereas the streak voltage corresponds to the voltage measured at the lower laser light energy (about 0.2 microjoules/$cm^2$), the discharge voltage (also referred to as residual voltage) corresponds to voltage at the higher laser energy.

Photoconductor drums may exhibit a loss of charge in the dark, i.e., may lose some charge before a light source discharges the charge. As used herein, "dark decay" refers to the loss of charge from the surface of a photoconductor when it is maintained in the dark. Dark decay is an undesirable feature as it reduces the contrast potential between image and background areas, leading to washed out images and loss of gray scale. Dark decay also reduces the field that the photoconductive process will experience when light is brought back to the surface, thereby reducing the operational efficiency of the photoconductor.

As used herein, "fatigue" refers to the tendency for a photoconductor to exhibit increases(negative) or decreases (positive) in its discharge voltage. Fatigue is undesirable as it reduces the development factor resulting in light or washed out print or dark print, as well as print that varies from page to page.

As used here, "sensitivity" or "photosensitivity" refers to the ability of a photoconductor to discharge its voltage efficiently. The photosensitivity may be measured as the amount of light energy, in microjoules/$cm^2$, required to reduce the photoconductor's voltage from its initial charge to a lower charge. The photoconductors may be subjected to sensitivity measurements using a sensitometer fitted with electrostatic probes to measure the voltage magnitude as a function of light energy shining on the photoconductor surface. It is undesirable for a photoconductor to have poor sensitivity for such a photoconductor would require a large amount of light energy to discharge its voltage.

Additionally, the present invention is directed toward compositions used to form CTLs and CGLs, referred to as "charge transport compositions" and "charge generation compositions". Charge transport compositions in accordance with the present invention show improved pot-life. As used here, "pot-life" refers to the length of time a composition, particularly a charge transport composition used to prepare a charge transport layer, can be stored without the composition becoming too viscous to be easily applied to a substrate and without the resulting layer exhibiting any adverse effects. Preferably the earliest layer formed by the composition and the latest layer formed by the composition have substantially similar characteristics. If the characteristics of the earlier layers differ from the later layers, it may be necessary to dispose of and replace the composition even though it has not yet become so viscous that it is difficult to apply. It is advantageous for a composition to have a long pot-life in order to avoid frequent disposal and replacement of the composition.

Photoconductors of the present invention comprise a substrate and at least one layer selected from the group consisting of:

a) charge transfer layers comprising a charge transfer molecule, polycarbonate and a first polyaryl ether selected from the group consisting of polyaryletherketones, poly(aryl-perfluoroaryl ether)s, polyaryletherketone-hydrazones, polyaryletherketone-azines, and mixtures thereof;

b) charge generating layers comprising a pigment, polyvinylbutyral and a second polyaryl ether selected from the group consisting of polyaryletherketones, polyarylethersulfones and mixtures thereof; and c) mixtures thereof.

Polyaryl Ethers

As used herein, "polyaryl ethers" is intended to refer to polymers having a backbone comprising aromatic groups and ether linkages. The polyaryl ether polymers include both homopolymers and copolymers. The copolymers comprise at least two different monomer units, wherein at least one monomer unit has a backbone comprising aromatic groups and ether linkages. Preferred polyaryl ethers for use in forming compositions and photoconductors in accordance with the present invention include polyaryletherketones (PAEKs), polyarylethersulfones (PAESs), poly(aryl-perfluoroaryl ether)s (PAPFAEs), polyaryletherketones-hydrazones (PAEK-hydrazones), and polyaryletherketone-azines (PAEK-azines) and mixtures and copolymers thereof.

As used herein, "polyaryletherketones" is intended to refer to polymeric compounds having a polymeric backbone comprising aromatic rings, ether linkages and ketone linkages, while "polyarylethersulfones" is intended to refer to polymeric compounds having a polymeric backbone comprising aromatic rings, ether linkages and sulfone linkages. "Polyaryletherketone-azines" is intended to refer to PAEK polymers wherein at least one of the ketones of the polymeric backbone has been replaced with an azine, while "polyaryletherketones-hydrazones" is intended to refer to polymers wherein at least one of the ketones of the polymer backbone has been replaced with a hydrazone. "Poly(aryl-perfluoroaryl ether)s" is intended to refer to polymeric compounds having a backbone comprising aromatic groups, at least one of which is perfluorinated, and ether linkages. The polymeric compounds may be homopolymers or copolymers. Preferably the molecular weights of the polymers are from about 2,000 to about 100,000, more preferably from about 10,000 to about 70,000.

There are several ways of synthesizing PAEKs and PAESs, such as a Friedel-Crafts reaction of stoichiometric amounts of aromatic bisbenzoyl chlorides with arenes, a nucleophilic displacement reaction of stoichiometric quantities of bisphenolate salts with activated aromatic dihalides in polar aprotic solvents, and a phase transfer catalyzed nucleophilic displacement reaction of bisphenols with hexafluorobenzene.

While not being bound by theory, the PAEK and PAES reactions are believed to proceed as set forth below in Reaction Sequence 1.

Reaction Sequence 1. Preparation of Polyaryletherketones and Polyarylethersulfones

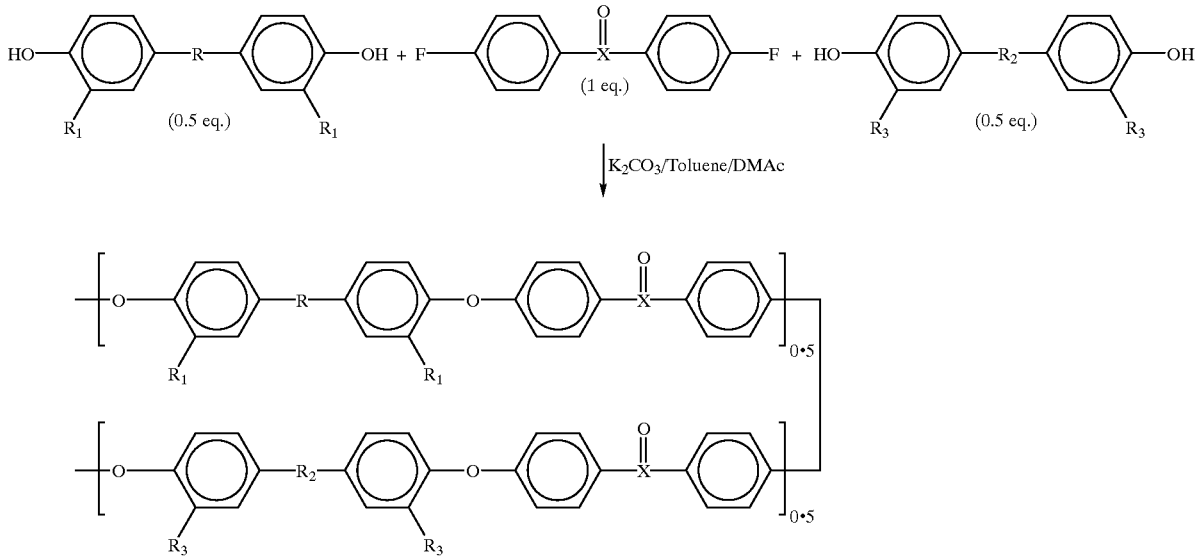

Where X = C or S = O; $R_1$ and $R_3$ = H or $CH_3$

R and $R_2$ = C(CH3)2; 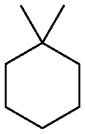 ; 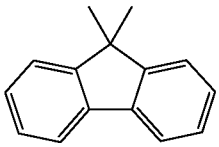 ;or 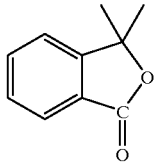

The PAEKs and PAESs may be synthesized by the polymerization reaction of stoichiometric amounts of one or more bisphenol compounds, such as bisphenols or bisphenolate salts, with a dihalobenzophenone or a dihalophenylsulfone in a polar aprotic solvent, such as N,N-dimethylacetamide (DMAc), and an azeotroping solvent, such as toluene, under refluxing conditions. In one embodiment, at least two different bisphenol compounds are employed. The reaction is generally catalyzed by a base, preferably an inorganic base such as potassium carbonate ($K_2CO_3$), potassium hydroxide (KOH) or cesium fluoride (CsF). Generally two equivalents of the base are used with respect to the bisphenol. The water formed in the reaction may be removed by any convenient means, such as by forming an azeotrope with toluene. The reaction mixture is stirred under refluxing temperature to increase the degree of polymerization. The polymerization may be quenched in water, and the resulting product may be chopped in a high speed blender. The polymer may be isolated by filtration, neutralized, stirred in boiling water, stirred in boiling methanol, and then dried.

Preferred PAEKs and PAESs include those shown in Reaction Sequence 1.

$R_1$ and $R_3$ may be identical or different, and R and $R_2$ may be identical or different. In one embodiment R and $R_2$ are different.

PAEK polymers may be modified to replace at least one of the ketones of the polymeric backbone with an azine or a hydrazone. The modification of a PAEK to the corresponding PAEK-hydrazone may be accomplished by the condensation of the PAEK with a hydrazine, while the modification of a PAEK to the corresponding PAEK-azine may be accomplished by the condensation of the PAEK with a hydrazone. PAEK-hydrazones comprise a group having the general structure:

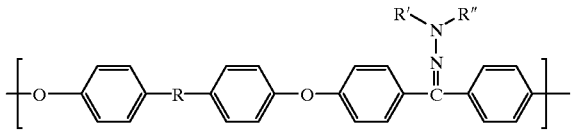

while PAEK-azines comprise a group having the general structure:

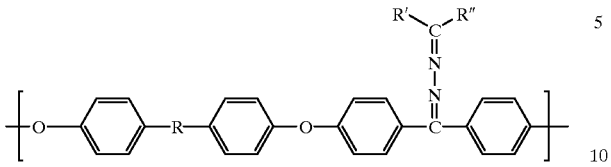

The R' and R" groups may be identical or different, further the R' and R" groups may be linked to form a ring structure, such as a fluorene structure. As one of ordinary skill will appreciate, the exact structures of the R' and R" groups depend upon the hydrazines or hydrazones used.

Suitable hydrazines include dialkylhydrazines, diarylhydrazines and aralkylhydrazines, such as 1,1-diphenylhydrazine hydrochloride, phenyl methylhydrazine and dimethylhydrazine, while suitable hydrazones include dialkylhydrazones and aralkylhydrazones, such as 9-fluorenone hydrazone, diarylhydrazone, dialkylhydrazone and aralkyl hydrazone. In one embodiment less than all of the ketone groups of the PAEK are converted, and the resulting polymers are co-polymers of either a ketone and an azine pendant, or a ketone and a hydrazone pendant. While not being bound by theory, the formations of the pendant azines and the pendant hydrazones are believed to proceed as set forth below in Reaction Sequences 2 and 3, respectively.

Reaction Sequence 2. Synthesis of PAEK-azines

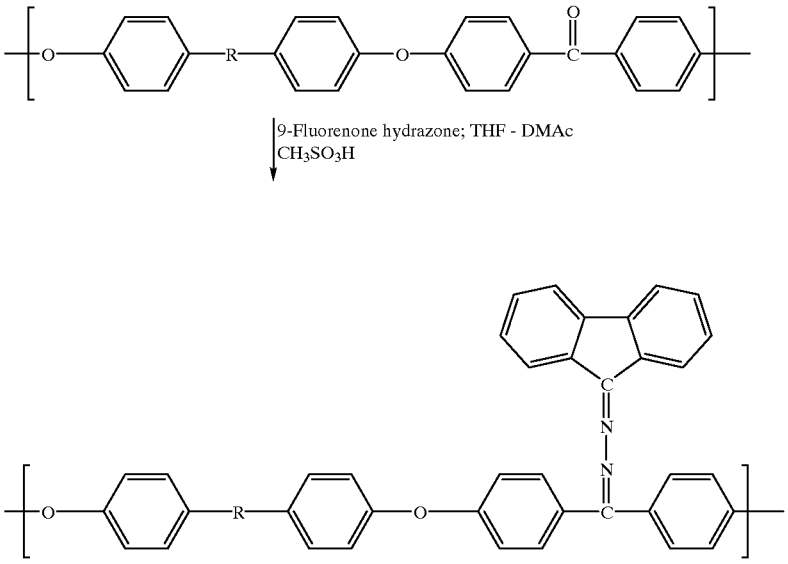

Reaction Sequence 3. Synthesis of PAEK-hydrazones

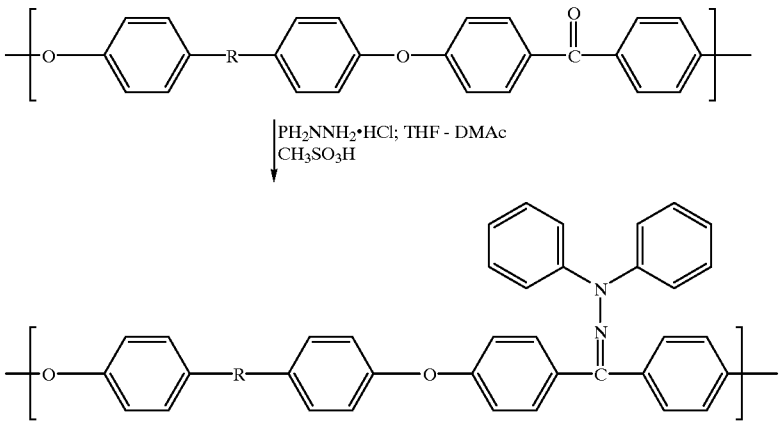

Preferred PAEK-azines and PAEK-hydrazones include those set forth in Reaction Sequences 2 and 3, respectively.

PAPFAEs may be synthesized by, for example, the polymerization reaction of stoichiometric amounts of one or more bisphenol compounds, such as bisphenols or bisphenolate salts, with a perfluoro aromatic compound, such as decafluorobiphenyl, perfluorobenzophenone and perfluorophenylsulfone, in N,N-dimethylacetamide. In one embodiment at least two different bisphenol compounds are employed. While not being bound by theory, the reaction is believed to proceed as set forth below in Reaction Sequence 4.

Reaction Sequence 4. Preparation of Poly(aryl-perfluoroaryl Ether )s

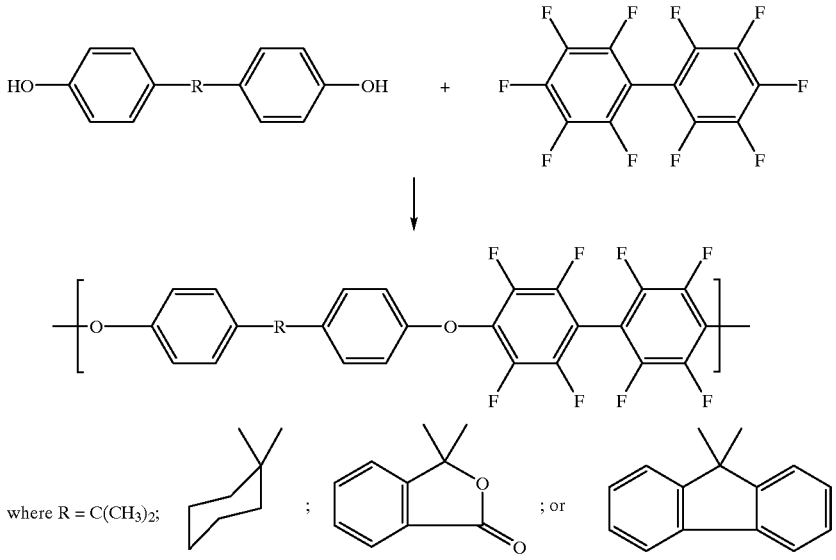

Preferred PAPFAEs include those set forth in Reaction Sequence 4.

The reaction is generally catalyzed by a base, preferably an inorganic base such as potassium carbonate ($K_2CO_3$), or cesium fluoride (CsF). Generally two equivalents of the base are used with respect to the bisphenol. The polymerization may be quenched in water, and the resulting product may be chopped in a high speed blender. The polymer may be isolated by filtration, neutralized, stirred in boiling water, stirred in boiling methanol, and then dried.

In the synthesis of the PAPFAEs, the reaction temperature during the polymerization is generally less than the refluxing temperature. As used herein, "refluxing temperature" refers to the temperature at which the solvent boils in the solution. If the reaction temperature is substantially close to the refluxing temperature (>145° C.), the polymerization mixtures become highly viscous and cross-linked. The reaction temperature is a temperature below which such cross-linking occurs. Generally, the reaction temperature is less than 145° C., preferably the reaction temperature is from about 50° C. to about 140° C., more preferably the reaction temperature is about 120° C.

Preferred PAPFAEs are soluble in organic solvents. Particularly preferred are PAPFAEs which are soluble in tetrahydrofuran (THF), chlorinated hydrocarbons (such as dichloromethane and chloroform), dioxane and polar aprotic solvents (such as dimethyl acetamide, dimethyl formamide, N-methyl-2-pyrrolidinone and methyl sulfoxide).

The polyaryl ethers may be synthesized using any suitable bisphenol compound. Preferred bisphenol compounds are selected from the group consisting of bisphenol-A, cyclohexylidenebiphenol, fluorenylidenebisphenol, phenolphthalein, methylbisphenol-A, bisphenolate salts and mixtures thereof. In a preferred embodiment the polyaryl ethers are synthesized from two different bisphenol compounds.

Charge Transport Compositions and Layers

Charge transport layers in accordance with the present invention comprise at least one charge transport molecule, polycarbonate and a polyaryl ether selected from the group consisting of polyaryletherketones, poly(arylperfluoro ethers)s, polyaryletherketones-hydrozones, polyaryletherketones-azines and mixtures thereof. The weight ratio of the polycarbonate to the polyaryl ether is generally in the range of from about 93:7 to about 75:25, preferably in the range of from about 93:7 to about 85:15.

Conventional charge transport compounds suitable for use in the charge transport layer of the photoconductors of the present invention should be capable of supporting the injection of photo-generated holes or electrons from the charge generation layer and allowing the transport of these holes or electrons through the charge transport layer to selectively discharge the surface charge. Suitable charge transport compounds for use in the charge transport layer include, but are not limited to, the following:

1. Diamine transport molecules of the types described in U.S. Pat. Nos. 4,306,008, 4,304,829, 4,233,384, 4,115,116, 4,299,897, 4,265,990 and/or 4,081,274. Typical diamine transport molecules include benzidine compounds, including substituted benzidine compounds such as the N,N'-diphenyl-N,N'-bis(alkylphenyl)-[1,1'-biphenyl]-4,4'-diamines wherein the alkyl is, for example, methyl, ethyl, propyl, n-butyl, or the like, or halogen substituted derivatives thereof, and the like.

2. Pyrazoline transport molecules as disclosed in U.S. Pat. Nos. 4,315,982, 4,278,746 and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl)pyrazoline, 1-phenyl-3-[p-diethylaminostyryl]-5-(p-dimethylaminostyryl)pyrazoline, 1-phenyl-3-[p-diethylaminostyryl]-5-(p-diethylaminostyryl) pyrazoline, and the like.

3. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2,4'-dimethoxybenzylidene)fluorene, 2-nitro-9-benzylidene-fluorene, 2-nitro-9-(4'-diethylaminobenzylidene)fluorene and the like.

4. Oxadiazole transport molecules such as 2,5-bis(4-diethylaminophenyl)-1,3,4-oxadiazole, imidazole, triazole, and others as described in German Patents Nos. 1,058,836, 1,060,260 and 1,120,875 and U.S. Pat. No. 3,895,944.

5. Hydrazone transport molecules including p-diethylaminobenzaldehyde-(diphenylhydrazone), p-diphenylaminobenzaldehyde-(diphenylhydrazone), o-ethoxy-p-diethylaminobenzaldehyde-(diphenylhydrazone), o-methyl-p-diethylaminobenzaldehyde-(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example, in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example, in U.S. Pat. Nos. 4,385,106, 4,338,388, 4,387,147, 4,399,208 and 4,399,207. Yet other hydrazone charge transport molecules include carbazole phenyl hydrazones such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426.

Preferably, the charge transport compound included in the charge transport layer comprises a hydrazone, an aromatic amine (including aromatic diamines such as benzidine), a substituted aromatic amine (including substituted aromatic diamines such as substituted benzidines), or a mixture thereof. Preferred hydrazone transport molecules include derivatives of aminobenzaldehydes, cinnamic esters or hydroxylated benzaldehydes. Exemplary aminobenzaldehyde-derived hydrazones include those set forth in the Anderson et al U.S. Pat. Nos. 4,150,987 and 4,362,798, while exemplary cinnamic ester-derived hydrazones and hydroxylated benzaldehyde-derived hydrazones are set forth in the copending Levin et al U.S. Applications Ser. Nos. 08/988,600 and 08/988,791, respectively, all of which patents and applications are incorporated herein by reference.

In one embodiment the charge transport compound comprises a compound selected from the group consisting of poly(N-vinylcarbazole)s, poly(vinylanthracene)s, poly(9,10-anthracenenylene-dodecanedicarboxylate)s, polysilanes, polygermanes, poly(p-phenylene-sulfide), hydrazone compounds, pyrazoline compounds, enamine compounds, styryl compounds, arylmethane compounds, arylamine compounds, butadiene compounds, azine compounds, and mixtures thereof. In a preferred embodiment the charge transport compound comprises a compound selected from the group consisting of p-diethylaminobenzaldehyde-(diphenylhydrazone) (DEH), N,N'-bis-(3-methylphenyl)-N,N'-bis-phenyl-benzidine (TPD) and mixtures thereof. TPD has the formula:

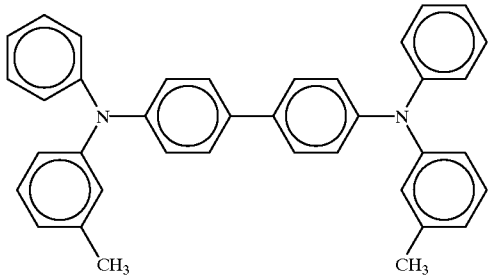

The charge transport layer typically comprises the charge transport compound in an amount of from about 5 to about 60 weight percent, more preferably in an amount of from about 15 to about 40 weight percent, based on the weight of the charge transport layer, with the remainder of the charge transport layer comprising the polycarbonate, the polyaryl ether and any conventional additives.

Suitable polycarbonates include polycarbonate-A's, polycarbonate-Z's, and mixtures thereof. Preferred polycarbonates have a number average molecular weight of from about 10,000 to about 100,000, preferably from about 20,000 to about 80,000. A preferred polycarbonate includes a polycarbonate-A having the structure set forth below:

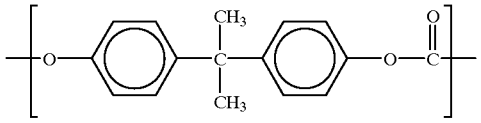

Such a polycarbonate-A is available from Bayer Corporation as MAKROLON®-5208 Polycarbonate, having a number average molecular weight of about 34,000.

The polyaryl ethers used in the charge transport layer have a number average molecular weight of at least about 2,000, preferably at least about 5,000, more preferably at least about 10,000, and even more preferably at least about 20,000. The polyaryl ethers generally have a molecular weight no greater than about 100,000, preferably no greater than abut 70,000. In one embodiment, the charge transport layer comprises a polymer selected from the group consisting of polyaryl ether sulfones and polyaryl etherketones having a molecular weight in the range of from about 2,000 to about 100,000, preferably from about 10,000 to about 40,000. In another embodiment, the charge transport layer comprises a polyaryl-perfluoroaryl ether having a number average molecular weight in the range of from about 5,000 to about 100,000, preferably from about 20,000 to about 70,000. In another embodiment, the charge transport layer comprises a polyaryletherketone-hydrazine and/or polyaryletherketone-azine having a number average molecular weight in the range of from about 20,000 to about 100,000, preferably from about 10,000 to about 60,000.

The charge transport layer will typically have a thickness of from about 10 to about 40 microns and may be formed in accordance with conventional techniques known in the art.

Conveniently, the charge transport layer may be formed by preparing a charge transport composition, coating the charge transport composition on the respective underlying layer and drying the coating.

To form the charge transport composition according to the present invention, the polycarbonate, polyaryl ether and the charge transport compound are dispersed or dissolved in an organic liquid. Although the composition which forms the charge transport layer may be referred to as a solution, the polycarbonate, polyaryl ether and charge transport compound may disperse rather than dissolve in the organic liquid, thus the composition may be in the form of a dispersion rather than a solution. The polycarbonate, polyaryl ether and charge transport compound may be added to the organic liquid simultaneously or consecutively, in any order of addition. Suitable organic liquids are preferably essentially free of amines and therefore avoid environmental hazards conventionally incurred with the use of amine solvents. Suitable organic liquids include, but are not limited to, tetrahydrofuran, 1,2-dioxane, 1,4-dioxane, and the like. Additional solvents suitable for dispersing the charge transport compound, polycarbonate and polyaryl ether blend will be apparent to those skilled in the art.

The charge transport composition generally comprises, by weight, from about 30% to about 70%, preferably from about 50% to 70%, of the polycarbonate and from about 0.5% to about 30%, preferably from about 0.5% to 15%, of the polyaryl ether. The polycarbonate and the polyaryl ether form a binder blend. The weight ratio of polycarbonate and the polyaryl ether in the binder blend is from about 93:7 to about 75:25, preferably from about 93:7 to about 85:15.

Charge Generation Compositions and Layers

Charge generation layers in accordance with the present invention comprise a charge generation molecule, polyvinylbutyral and a polyaryl ether selected from the group consisting of polyaryletherketones, polyaryl ether sulfones and mixtures thereof. The polyaryletherketones and polyarylether sulfones generally have a number average molecular weight from about 2,000 to about 100,000, preferably from about 10,000 to about 40,000.

Polyvinylbutyral polymers are well known in the art and are commercially available from various sources. These polymers are typically made by condensing polyvinyl alcohol with butyraldehyde in the presence of an acid catalyst, for example sulfuric acid, and contain a repeating unit of formula:

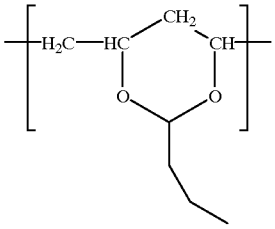

Typically, the polyvinylbutyral polymer will have a number average molecular weight of from about 20,000 to about 300,000. The weight ratio of the polyvinylbutyral to the polyaryl ether in the charge generation layer is generally in the range of from about 25:75 to about 90:10, preferably from about 25:75 to about 75:25.

Various organic and inorganic charge generation compounds are known in the art, any of which are suitable for use in the charge generation layers of the present invention. One type of charge generation compound which is particularly suitable for use in the charge generation layers of the present invention comprises the squarylium-based pigments, including squaraines. Squarylium pigment may be prepared by an acid route such as that described in U.S. Pat. Nos. 3,617,270, 3,824,099, 4,175,956, 4,486,520 and 4,508,803, which employs simple procedures and apparatus, has a short reaction time and is high in yield. The squarylium pigment is therefore very inexpensive and is easily available.

Preferred squarylium pigments suitable for use in the present invention may be represented by the structural formula:

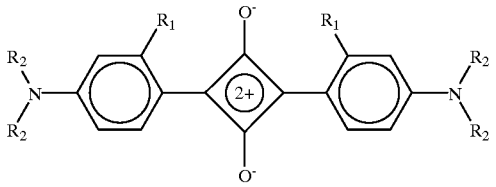

wherein $R_1$ represents hydroxy, hydrogen or $C_{1-5}$ alkyl, preferably hydroxy, hydrogen or methyl, and each $R_2$ individually represents $C_{1-5}$ alkyl or hydrogen. In a further preferred embodiment, the pigment comprises a hydroxy squaraine pigment wherein each $R_1$ in the formula set forth above comprises hydroxy.

Another type of pigment which is particularly suitable for use in the charge generation layers of the present invention comprises the phthalocyanine-based compounds. Suitable phthalocyanine compounds include both metal-free forms such as the X-form metal-free phthalocyanines and the metal-containing phthalocyanines. In a preferred embodiment, the phthalocyanine charge generation compound may comprise a metal-containing phthalocyanine wherein the metal is a transition metal or a group IIIA metal. Of these metal-containing phthalocyanine charge generation compounds, those containing a transition metal such as copper, titanium or manganese or containing aluminum or gallium as a group IIIA metal are preferred. These metal-containing phthalocyanine charge generation compounds may further include oxy, thiol or dihalo substitution. Titanium-containing phthalocyanines as disclosed in U.S. Pat. Nos. 4,664,997, 4,725,519 and 4,777,251, including oxo-titanyl phthalocyanines, and various polymorphs thereof, for example type IV polymorphs, and derivatives thereof, for example halogen-substituted derivatives such as chlorotitanyl phthalocyanines, are suitable for use in the charge generation layers of the present invention.

Additional conventional charge generation compounds known in the art, including, but not limited to, disazo compounds, for example as disclosed in the Ishikawa et al U.S. Pat. No. 4,413,045, and tris and tetrakis compounds as known in the art, are also suitable for use in the charge generation layers of the present invention. It is also within the scope of this invention to employ a mixture of charge generation pigments or compounds in the charge generation layer.

In one embodiment of the invention, the charge generation molecule is a pigment selected from the group consisting of azo pigments, anthraquinone pigments, polycyclic quinone pigments, indigo pigments, diphenylmethane pigments, azine pigments, cyanine pigments, quinoline pigments, benzoquinone pigments, napthoquinone pigments, naphthalkoxide pigments, perylene pigments, fluorenone pigments, squarylium pigments, azuleinum pigments, quinacridone pigments, phthalocyanine pigments, naphthaloxyanine pigments, porphyrin pigments and mixtures thereof. In a preferred embodiment, the charge generation molecule is a pigment selected from the group consisting of hydroxy squaraines, Type IV oxotitanium phthalocyanines, and mixtures thereof.

The charge generation layers may comprise the charge generation compound in amounts conventionally used in the art. Typically, the charge generation layer may comprise from about 5 to about 80, preferably at least about 10, and more preferably from about 15 to about 60, weight percent of the charge generation compound, and may comprise from about 20 to about 95, preferably not more than about 90, and more preferably comprises from about 40 to about 85, weight percent of the total of the polyvinylbutryal and the polyaryl ether, all weight percentages being based on the charge generation layer. The charge generation layers may further contain any conventional additives known in the art for use in charge generation layers.

To form the charge generation layers according to the present invention, the polyvinylbutryal, polyaryl ether and the charge generation compound are dissolved and dispersed, respectively, in an organic liquid. Although the organic liquid may generally be referred to as a solvent, and typically dissolves the polyvinylbutryal and the polyaryl ether, the liquid technically forms a dispersion of the pigment rather than a solution. The polyvinylbutryal, polyaryl ether and pigment may be added to the organic liquid simultaneously or consecutively, in any order of addition. Suitable organic liquids are preferably essentially free of amines and therefore avoid environmental hazards conventionally incurred with the use of amine solvents. Suitable organic liquids include, but are not limited to, tetrahydrofuran, cyclopentanone, 2-butanone and the like. Additional solvents suitable for dispersing the charge generation compound, polyvinylbutryal and polyaryl ether blend will be apparent to those skilled in the art.

The charge generation composition generally comprises, by weight, from about 0.5% to 20%, preferably from about 1% to 7%, of the polyvinylbutyral and from about from about 0.5% to 20%, preferably from about 0.5% to 3%, of the polyaryl ether. The polyvinylbutyral and the polyaryl ether form a binder blend. In one embodiment the binder blend comprises, by weight, 0.5% to 3% polyvinylbutyral and 0.5% to 3% polyaryl ether. The weight ratio of polyvinylbutyral and the polyaryl ether in the binder blend is from about 95:5 to about 5:95, preferably from about 75:25 to about 25:75.

In accordance with techniques generally known in the art, the composition preferably contains not greater than about 10 weight percent solids comprising the polyvinylbutryal, the polyaryl ether and charge generation compound in combination. The compositions may therefore be used to form a charge generation layer of desired thickness, typically not greater than about 5 microns, and more preferably not greater than about 1 micron, in thickness. Additionally, a homogeneous layer may be easily formed using conventional techniques, for example dip coating or the like. These compositions also reduce any wash or leach of the charge generation compound into a charge transport layer coating which is subsequently applied to the charge generation layer.

The charge generation layers according to the present invention exhibit good adhesion to underlying layers. Typically, the charge generation layer will be applied to a photoconductor substrate, with a charge transport layer formed on the charge generation layer. In accordance with techniques known in the art, one or more barrier layers may be provided between the substrate and the charge generation layer. Typically, such barrier layers have a thickness of from about 0.05 to about 20 microns. It is equally within the scope of the present invention that the charge transport layer is first formed on the photoconductor substrate, followed by formation of the charge generation layer on the charge transport layer.

Photoconductors

The photoconductor substrate may be flexible, for example in the form of a flexible web or a belt, or inflexible, for example in the form of a drum. Typically, the photoconductor substrate is uniformly coated with a thin layer of a metal, preferably aluminum, which functions as an electrical ground plane. In a further preferred embodiment, the aluminum is anodized to convert the aluminum surface into a thicker aluminum oxide surface. Alternatively, the ground plane member may comprise a metallic plate formed, for example, from aluminum or nickel, a metallic drum or foil, or a plastic film on which aluminum, tin oxide, indium oxide or the like is vacuum evaporated. Typically, the photoconductor substrate will have a thickness adequate to provide the required mechanical stability. For example, flexible web substrates generally have a thickness of from about 0.01 to about 0.1 microns, while drum substrates generally have a thickness of from about 0.75 mm to about 1 mm.

In the examples and throughout the present specification, parts and percentages are by weight unless otherwise indicated.

EXAMPLES

PAEKs and PAESs

Example A

PAEKs and PAESs were synthesized by the aromatic nucleophilic displacement reaction of a difluorobenzophenone or a difluorophenylsulfone using various potassium bisphenolates. The reactions were performed in N,N-dimethylacetamide solvent. The potassium bisphenolates were typically generated in situ by the reaction of a bisphenol with potassium carbonate, and the water formed thereby was removed by azeotropic distillation using toluene. In most cases, following the azeotropic removal of water and toluene and refluxing in the dimethylacetamide solvent, which required about 2 hours, the reaction mixture became viscous.

All polymers were isolated by precipitation. Typical work-ups included the steps of stirring the off-white fibrous polymer in water with a high speed blender, neutralization with aqueous acid (about 5% HCl), filtering, stirring in boiling water for 1 hour, filtering, stirring in boiling methanol for about 0.5 hour, filtering and drying at about 100° C. for about 16 hours in a vacuum oven. Yields for the polymerizations were about 90%.

The polymers comprised the structure:

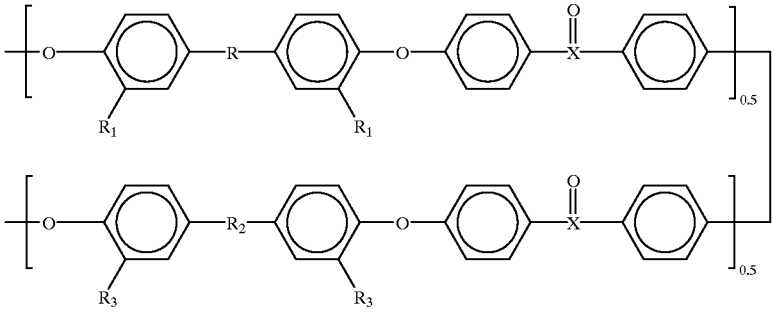

Where X=C or S=O; $R_1$ and $R_3$=H or $CH_3$ R and $R_2$=C (CH3)2;

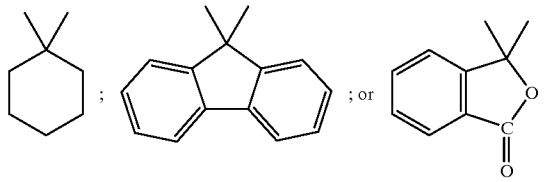

Specific structures are set forth in Tables 1 and 2. The entry "Nil" indicates that the polyaryl ether was a homopolymer (that is, "Nil" indicates R and $R_2$ were the same). Ratios of $R/R_2$ are molar ratios. $R_1$ and $R_3$ are hydrogen unless indicated otherwise.

Characterization of representative polymers is given in Tables 1 and 2.

Several particular synthesis reactions are as set forth below:

Poly(bisphenol-A-benzophenone) (P(BPA-BNZPH))

In a three neck 500 mL round-bottom flask was weighed bisphenol-A (6.0000 g, 26.28 mmol), potassium carbonate (7.25 g, 52.56 mmol), 4,4'-difluorobenzophenone (5.7343 g, 26.28 mmol), toluene (35 g) and NN-dimethylacetamide (72 g). The flask was fitted with a condenser and a thermometer. The mixture was stirred and heated to reflux. The water formed in the reaction was azeotropically distilled with toluene. On complete removal of water and toluene, the solution was stirred at reflux for about 2 hours. The vicous polymer solution was precipitated in water, and a white fibrous polymer was isolated by filtration. The white polymer was stirred in boiling water for about 1 hour, filtered, stirred in boiling methanol for about 1 hour and filtered. The fibrous white polymer was then dried in an vacuum oven for about 16 hours at 100° C. The yield was about 9.93 g. The number average molecular weight of the polymer was about 11.0K.

TABLE 1

Characterization of homo- and co-poly(arylether ketone)s

| Polymer | R | $R_2$ | $R/R_2$ | X | Mn | Mw | Polyd. |
|---|---|---|---|---|---|---|---|
| Polymer I | Isopropyl | Nil | 100/0 | C | 11043 | 21809 | 1.88 |
| Polymer II | Cyclohexyl | Nil | 100/0 | C | 30203 | 60476 | 2.00 |
| Polymer III | Cyclohexyl | Nil | 100/0 | C | 70006 | 147106 | 2.10 |
| Polymer IV | Phthalidene | Nil | 100/0 | C | 24537 | 45753 | 1.86 |
| Polymer V | Phthalidene | Nil | 100/0 | C | 40453 | 74272 | 1.84 |
| Polymer VI | Fluorenyl | Nil | 100/0 | C | 35571 | 66301 | 1.86 |
| Polymer VII | Fluorenyl | Nil | 100/0 | C | 20607 | 33602 | 1.63 |
| Polymer VIII | Isopropyl, $R_1 = CH_3$ | Nil | 100/0 | C | 8244 | 17751 | 2.15 |
| Polymer IX | Isopropyl | Cyclohexyl | 50/50 | C | 47855 | 86601 | 1.81 |
| Polymer X | Cyclohexyl | Phthalidene | 50/50 | C | 22638 | 39514 | 1.75 |
| Polymer XI | Isopropyl | Fluorenyl | 50/50 | C | 9882 | 18230 | 1.84 |
| Polymer XII | Isopropyl | Phthalidene | 50/50 | C | 35149 | 64652 | 1.84 |

Mn = Number average molecular weight; Mw = Weight average molecular weight; Polyd. = Polydispersity; $R/R_2$ '2 Molar Ratio of R to $R_2$

TABLE 2

Characterization of Poly(arylethersulfone)s

| Polymer | R | $R_2$ | $R/R_2$ | X | Mn | Mw | Polyd. |
|---|---|---|---|---|---|---|---|
| Polymer XIII | Isopropyl | Nil | 100/0 | S(O) | 19491 | 33892 | 1.74 |
| Polymer XIV | Cyclohexyl | Nil | 100/0 | S(O) | 21337 | 35634 | 1.67 |
| Polymer XV | Phthalidene | Nil | 100/0 | S(O) | 28851 | 44776 | 1.55 |
| Polymer XVI | Fluorenyl | Nil | 100/0 | S(O) | ND | ND | ND |
| Polymer XVII | Isopropyl, $R_1 = CH_3$ | Nil | 100/0 | S(O) | ND | ND | ND |
| Polymer XVIII | Isopropyl | Cyclohexyl | 50/50 | S(O) | 22617 | 40466 | 1.79 |
| Polymer XIX | Cyclohexyl | Phthalidene | 50/50 | S(O) | 40698 | 64966 | 1.60 |
| Polymer XX | Cyclohexyl | Fluorenyl | 50/50 | S(O) | 53855 | 91339 | 1.70 |
| Polymer XXI | Isopropyl | Phthalidene | 50/50 | S(O) | 50983 | 93505 | 1.83 |

ND = Not Determined; Mn = Number Average Molecular Weight; Mw = Weight average molecular weight; Polyd. = Polydispersity; $R/R_2$ = Molar Ratio of R to $R_2$; S(O) represents S=O Poly(bisphenol-Z-benzophenone) (P(BPZ-BNZPH))

In a three neck 500 mL round-bottom flask was weighed bisphenol-Z (35.0000 g, 130.42 mmol), potassium carbonate (36.0505 g, 260.45 mmol), 4,4'-difluorobenzophenone (28.4587 g, 130.42 mmol), toluene (115 g) and N,N-dimethylacetamide (233 g). The flask was fitted with a condenser and a thermometer. The light yellow mixture was stirred and heated to reflux. The water formed was azeotropically distilled with toluene. On complete removal of water and toluene, the solution was stirred at reflux for about 2 hours. The viscous polymer solution was precipitated in water, and a white fibrous polymer was isolated by filtration. The white polymer was stirred in boiling water for about 1 hour, filtered, and then stirred in boiling methanol for about 1 hour and filtered. The fibrous white polymer was then dried in an vacuum oven for about 16 hours at 100° C. The yield was about 54.35 g. The number average molecular weight of the polymer was about 11.5K.

Poly(fluorenylidenebisphenol-benzophenone) (P(FLUOBP-BNZPH))

Polymerization was carried out similar to the P(BPZ-BNZPH) polymerization, except 9,9-fluorenylidenebisphenol (8.0000 g, 22.829 mmol), potassium carbonate (6.31 g, 45.658 mmol), 4,4'-difluorobenzophenone (4.9815 g, 22.829 mmol), toluene (40 g) and N,N-dimethylacetamide (60 g) were used. The yield was about 11.38 g. The number average molecular weight of the polymer was about 35.5K.

Poly(phenolphthalein-benzophenone) (P(PHENOLPH-BNZPH))

Polymerization was carried out similar to the P(BPZ-BNZPH) polymerization, except phenolphthalein (15.0000 g, 47.12 mmol), potassium carbonate (13.02 g, 94.28 mmol), 4,4'-difluorobenzophenone (10.2819 g, 47.12 mmol), toluene (117 g) and N,N-dimethylacetamide 100 g) were used. The yield was about 21.87 g. The number average molecular weight of the polymer was about 40.4K.

Poly(methybisphenol-A-benzophenone) (P(MEBPA-BNZPH))

Polymerization was carried out similar to the P(BPZ-BNZPH) polymerization, except methylbisphenol-A (10.0000 g, 39.00 mmol), potassium carbonate (10.782 g, 78.00 mmol), 4,4'-difluorobenzophenone (8.5102 g, 39.00 mmol), toluene (50 g) and N,N-dimethylacetamide (85 g) were used. The yield was about 15.34 g. The number average molecular weight of the polymer was about 8.2K.

Poly(cyclohexylidenebisphenol-co-benzophenone-co-bisphenol-A-50/50) (P(BPZ-BNZPH-BPA))

Polymerization was carried out similar to the P(BPZ-BNZPH) polymerization, except 1,1-cyclohexylidenebisphenol (4.9194 g, 18.331 mmol), bisphenol-A (4.1849 g, 18.33 mmol), potassium carbonate (10.13 g, 73.32 mmol), 4,4'-difluorobenzophenone (8.0000 g, 36.66 mmol), toluene (50 g) and N,N-dimethylacetamide (80 g) were used. The yield was about 14.12 g. The number average molecular weight of the polymer was about 47.8K.

Poly(cyclohexylidenebisphenol-co-benzophenone-co-phenolphthalein-50/50) (P(BPZ-BNZPH-PHENOLPH))

Polymerization was carried out similar to the P(BPZ-BNZPH) polymerization, except 1,1-cyclohexylidenebisphenol (4.9194 g, 18.331 mmol), phenolphthalein (5.8354 g, 18.33 mmol), potassium carbonate (10.13 g, 73.32 mmol), 4,4'-difluorobenzophenone (8.0000 g, 36.66 mmol), toluene (50 g) and N,N-dimethylacetamide (86 g) were used. The yield was about 15.85 g. The number average molecular weight of the polymer was about 22.6K.

Poly(bisphenol-A-co-benzophenone-co-phenolphthalein-50/50) (P(BPZ-BNZPH-PHENOLPH))

Polymerization was carried out similar to the P(BPZ-BNZPH) polymerization, except bisphenol-A (4.1849 g, 18.33 mmol), phenolphthalein (5.8354 g, 18.33 mmol), potassium carbonate (10.12 g, 73.32 mmol), 4,4'-difluorobenzophenone (8.0000 g, 36.66 mmol), toluene (50 g) and N,N-dimethylacetamide (83 g) were used. The yield was about 13.87 g. The number average molecular weight of the polymer was about 35.1K.

Poly(fluorenylidenebisphenol-co-benzophenone-co-bisphenol-A-50/50) (P(FLUOBP-BNZPH-BPA))

Polymerization was carried out similar to the P(BPZ-BNZPH) polymerization, except 9,9-fluorenylidenebisphenol (4.8177 g, 13.74 mmol), bisphenol-A (3.1387 g, 13.74 mmol), potassium carbonate (7.60 g, 54.99 mmol), 4,4'-difluorobenzophenone (6.0000 g, 27.49 mmol), toluene (35 g) and N,N-dimethylacetamide (65 g) were used. The yield was about 10.39 g. The number average molecular weight of the polymer was about 9.8K.

Poly(cyclohexylidenebisphenol-co-phenylsulfone) (P(BPZ-SULFONE))

Polymerization was carried out similar to the P(BPZ-BNZPH) polymerization, except 1,1-cyclohexylidenebisphenol (6.0000 g, 22.35 mmol), potassium carbonate (6.18 g, 44.70 mmol), 4-fluorophenylsulfone (5.6847 g, 22.35 mmol), toluene (40 g) and N,N-dimethylacetamide (54 g) were used. The yield was about 9.67 g. The number average molecular weight of the polymer was about 21.3K.

Poly(phenolphthalein-sulfone) (P(PHENOLPH-SULFONE))

Polymerization was carried out similar to the P(BPZ-BNZPH) polymerization, except phenolphthalein (6.0000 g, 18.84 mmol), 4-fluorophenylsulfone (4.7923 g, 18.84 mmol), potassium carbonate (5.21 g, 37.69 mmol), toluene (40 g) and N,N-dimethylacetamide (50 g) were used. The yield was about 9.34 g. The number average molecular weight of the polymer was about 28.8K.

Poly(fluorenylidenebisphenol-co-phenylsulfone-co-cyclohexylidenebisphenol-50/50) (P(FLUOBP-BNZPH-BPZ))

Polymerization was carried out similar to the P(BPZ-BNZPH) polymerization, except 9,9-fluorenylidenebisphenol (4.1346 g, 11.79 mmol), cyclohexylidenebisphenol (3.1664 g, 13.74 mmol), potassium carbonate (6.52 g, 47.19 mmol), 4-fluorophenylsulfone (6.0000 g, 23.598 mmol), toluene (32 g) and N,N-dimethylacetamide (64 g) were used. The yield was about 11.66 g. The number average molecular weight of the polymer was about 53.8K.

Poly(phenolphthalein-co-phenylsulfone-co-bisphenol-A-50/50) (P(PHENOLPH-BNZPH-BPA))

Polymerization was carried out similar to the P(BPZ-BNZPH) polymerization, except phenolphthalein (3.7560 g, 11.79 mmol), cyclohexylidenebisphenol (3.7560 g, 11.79 mmol), potassium carbonate (6.52 g, 47.19 mmol), 4-fluorophenylsulfone (6.0000 g, 23.598 mmol), toluene (30 g) and N,N-dimethylacetamide (58 g) were used. The yield was about 10.97 g. The number average molecular weight of the polymer was about 50.9K.

Poly(phenolphthalein-co-phenylsulfone-co-cyclohexylidenebisphenol-50/50) (P(PHENOLPH-SULFONE-BPZ))

Polymerization was carried out similar to the P(BPZ-BNZPH) polymerization, except phenolphthalein (3.7560 g, 11.79 mmol), cyclohexylidenebisphenol (3.1663 g, 13.74 mmol), potassium carbonate (6.52 g, 47.19 mmol), 4-fluorophenylsulfone (6.0000 g, 23.59 mnmol), toluene (35 g) and N,N-dimethylacetamide (63 g) were used. The yield was about 11.29 g. The number average molecular weight of the polymer was about 40.6K.

Example B

The polyarylethers containing the carbonyl or sulfonyl units were used to prepare dispersions of pigments such as squaraines (HOSq) and Type IV oxotitanium phthalocyanine (TiOPc), in suitable solvent(s).

In contrast to the polyvinylbutyral-free PAEK dispersion, the blend of polyvinylbutyral with PAEK resulted in a highly stable dispersion. Dispersion stability lasting several months, and no phase separation was observed. The coating quality was poor in polyvinylbutyral-free dispersions having low levels of PAEK or PAES. That is, at low levels of solids in the polyvinylbutyral-free dispersions, such as from about 1% to about 5%, by weight solids, the coating appeared streaked. At high levels of solids in the polyvinylbutyral-free dispersions, such as from about 6% to about 20%, by weight solids, the coating quality was improved in that there were no apparent streaks, however, the resulting optical density was very high and often resulted in high dark decay. In contrast, the binder blends of polyvinylbutyral and polyaryl ethers resulted in excellent coating quality, even at lower dispersion solids.

Tables 3 and 4 set forth initial electricals for photoconductor drums in which the CGL's comprise polyvinylbutyral binder, PAEK binder, or polyvinylbutyral/PAEK binder blends, respectively.

TABLE 3

Initial electricals for drums having a CGL containing 40% HOSq and BX-55Z, PAEK, or BX-55Z/PAEK blends, and a CTL containing 30% TPD and Mak-5208

| BX-55Z/ Polymer I | Optical density | Charge voltage (−Vo) | $V_{0.21\mu J/cm^2}$ | $V_{0.42\mu J/cm^2}$ | Residual voltage (−Vr) | dark decay (V/sec) |
|---|---|---|---|---|---|---|
| 100/0 | 1.25 | −602 | −390 | −275 | −109 | 28 |
| 0/100 | 1.22 | −602 | −376 | −246 | −125 | 49 |
| 75/25 | 1.22 | −601 | −350 | −214 | −96 | 41 |
| 25/75 | 1.08 | −601 | −370 | −224 | −72 | 12 |

$V_{0.21\mu J/cm^2}$ = Voltage at 0.21 $\mu J/cm^2$; $V_{0.42\mu J/cm^2}$ = Voltage at 0.42 $\mu J/cm^2$
Polymer I: Poly(bisphenol-A-benzophenone)

TABLE 4

Initial electricals for drums having a CGL containing 40% HOSq dispersions prepared in BX-55Z, PAEK, or BX-55Z/PAEK blends, and a CTL containing 30% TPD and Mak-5208

| BX-55Z/ Polymer I | Optical density | Charge voltage (−Vo) | $V_{0.21\mu J/cm^2}$ | $V_{0.42\mu J/cm^2}$ | Residual voltage (−Vr) | dark decay (V/sec) |
|---|---|---|---|---|---|---|
| 100/0 | 1.31 | −598 | −386 | −250 | −107 | 35 |
| 0/100 | 1.22 | −598 | −382 | −247 | −123 | 44 |
| 75/25 | 1.22 | −597 | −386 | −245 | −109 | 32 |
| 25/75 | 1.08 | −601 | −389 | −248 | −90 | 16 |

$V_{0.21\mu J/cm^2}$ = Voltage at 0.21 $\mu J/cm^2$; $V_{0.42\mu J/cm^2}$ = Voltage at 0.42 $\mu J/cm^2$ Squaraine dispersions were prepared from HOSq pigment, PAEK comprising poly(bisphenol-A-benzophenone) (Polymer 1), described above, in a mixture of tetrahydrofuiran (THF) and cyclohexanone (90/10 w/w). The dispersions were stable for about 4–6 hours, and eventually phase separated. The dispersions were coated on anodized aluminum drums as a CG layer, followed by dip-coating in a charge transport solution. The HOSq/PAEK dispersions were compared to a standard control drum, prepared by using polyvinylbutyral as a CG binder polymer. In a similar manner, dispersions containing blends of polyvinylbutyral (BX-55Z) and a PAEK with a HOSq were also prepared and compared to the above dip-coated drums.

Tables 3 and 4 indicate that the drums in which the CGL comprises a binder blend of polyvinylbutyral and PAEK had improved sensitivity, i.e, it required less laser energy to discharge the photoconductor drum, in comparison to a drum in which the CGL binder comprises solely polyvinylbutyral or solely PAEK. Further, the drum comprising the binder blend exhibited a lower level of dark decay than the drum comprising PAEK binder.

A similar experiment was carried out with a PAES binder, at 30% HOSq pigment level and 30% TPD in transport. P(BPA-sulfone), P(Cyclohex-sulfone) and P(Phenolph-sulfone) correspond to Polymers XIII, XIV and XV, respectively, of Table 2. The results are presented below in Tables 5 and 6:

TABLE 5

Initial electricals for drums having a CGL containing 30% HOSq and BX-55Z/PAES binder blends and a CTL containing 30% TPD and Mak-5208

| PAES | BX-55Z/ PAES | Optical density | Charge voltage (−Vo) | $V_{0.21\mu J/cm^2}$ | $V_{0.42\mu J/cm^2}$ | Residual voltage (−Vr) |
|---|---|---|---|---|---|---|
| Nil | 100/0 | 1.07 | −596 | −464 | −392 | −305 |
| P(BPA-sulfone) | 50/50 | 1.03 | −598 | −455 | −363 | −250 |
| P(Cyclohex-sulfone) | 50/50 | 1.11 | −599 | −392 | −282 | −164 |
| P(Phenolph-sulfone) | 50/50 | 1.07 | −601 | −430 | −330 | −204 |

$V_{0.21\mu J/cm^2}$ = Voltage at 0.21 $\mu J/cm^2$; $V_{0.42\mu J/cm^2}$ = Voltage at 0.42 $\mu J/cm^2$

TABLE 6

Initial electricals for drums having a CGL containing 30% HOSq and BX-55Z/PAES binder blends and a CTL containing 40% DEH and Mak-5208

| PAES | BX-55Z/ PAES | Optical density | Charge voltage (−Vo) | $V_{0.21\mu J/cm^2}$ | $V_{0.42\mu J/cm^2}$ | Residual voltage (−Vr) |
|---|---|---|---|---|---|---|
| Nil | 100/0 | 1.03 | −602 | −455 | −375 | −281 |
| P(BPA-sulfone) | 50/50 | 1.04 | −600 | −432 | −323 | −230 |
| P(Cyclohex-sulfone) | 50/50 | 1.04 | −602 | −447 | −350 | −252 |
| P(Phenolph-sulfone) | 50/50 | 1.02 | −599 | −428 | −314 | −206 |

$V_{0.21\mu J/cm^2}$ = Voltage at 0.21 $\mu J/cm^2$; $V_{0.42\mu J/cm^2}$ = Voltage at 0.42 $\mu J/cm^2$

Example C

Several dispersions containing 45% Type IV TiOPc in a THF/cyclohexanone (90/10) mixture were prepared using BX-55Z, PAEK and polyvinylbutyral/PAEK blends. Table 7 summarizes the initial electricals obtained for photoconductors employing these systems at an expose-to-develop time of 110 ms.

TABLE 7

Initial electricals for drums having a CGL containing 45% TiOPc in various CG binder blends and a CTL containing 30% TPD and Mak-5208

| Binder | BX-55Z/ PAEK | Optical density | Charge voltage (−Vo) | $V_{0.21\mu J/cm^2}$ | $V_{0.42\mu J/cm^2}$ | Residual voltage (−Vr) | Dark decay (V/sec) |
|---|---|---|---|---|---|---|---|
| BX-55Z | 100/0 | 1.55 | −698 | −212 | −144 | −109 | 38 |
| P(BPA-ketone) | 0/100 | 1.43 | −700 | −182 | −133 | −114 | 23 |
| P(BPA-ketone) | 75/25 | 1.37 | −697 | −142 | −109 | −90 | 33 |
| P(Phenolph-ketone) | 75/25 | 1.38 | −700 | −163 | −124 | −97 | 29 |
| P(CycloBP-ketone) | 75/25 | 1.48 | −698 | −132 | −94 | −79 | 13 |

$V_{0.21\mu J/cm^2}$ = Voltage at 0.21 $\mu J/cm^2$; $V_{0.42\mu J/cm^2}$ = Voltage at 0.42 $\mu J/cm^2$

Example D

Co-polymers of PAEKs were also evaluated. Photoconductor drums comprising CGL's having the PAEK-containing binder blends and 35% TiOPc pigment were evaluated to determine if the sensitivity attained from the lower pigment/binder ratio will match that attained in photoconductors in which the CGL has a higher pigment level (45% TiOPc). Photoconductors having CGL's containing the polyvinylbutyral/Co-PAEK blends result in improved sensitivity and are similar or better than those employing a higher pigment/polyvinylbutyral type sensitivity. The lower pigment and higher binder level may result in improved adhesion of the coatings to the core. The results are summarized in Table 8 below.

TABLE 8

Initial electricals for drums having a CGL comprising BX-55Z/Co-PAEKs and TiOPc and CTL comprising 45% or 35% TPD and Mak-5208 (76 ms expose-to-develop)

| Binder | BX-55Z/ PAEK | Pigment % | Optical density | Charge voltage (−Vo) | $V_{0.21\mu J/cm^2}$ | $V_{0.42\mu J/cm^2}$ | Residual voltage (−Vr) |
|---|---|---|---|---|---|---|---|
| BX-55Z | 100/0 | 45 | 1.61 | −852 | −332 | −144 | −95 |
| BX-55Z | 0/100 | 35 | 1.64 | −848 | −412 | −311 | −236 |
| P(BPA-BPZ-ketone) | 50/50 | 35 | 1.62 | −851 | −295 | −166 | −136 |
| P(BPA-Fluorenyl-ketone) | 50/50 | 35 | 1.58 | −848 | −277 | −135 | −108 |
| P(BPA-Phenolph-ketone) | 50/50 | 35 | 1.59 | −851 | −287 | −157 | −130 |
| P(BPZ-Phenolph-ketone) | 50/50 | 35 | 1.62 | −848 | −275 | −145 | −121 |
| P(BPA-ketone) | 50/50 | 35 | 1.33 | −848 | −305 | −140 | −112 |

$V_{0.21\mu J/cm^2}$ = Voltage at 0.21 $\mu J/cm^2$; $V_{0.42\mu J/cm^2}$ = Voltage at 0.42 $\mu J/cm^2$ The use of blends of polyvinylbutyral and homo-or copolymers of PAEKs or PAESs in the CGL result in photoconductors having improved sensitivity and reduced dark decay as compared to binders comprising solely polyvinylbutyral or solely PAEK.

Example E

Polyarylethersulfones were formulated as a 25% blend with polycarbonate-A (Makrolon-5208) in charge transport layers with N,N'-bis(3-methylphenyl)-N,N'-bisphenylbenzidine (TPD) or p-diethylaminobenzaldehyde-(diphenylhydrazone) (DEH) charge transport materials. The resulting drum did not exhibit photoconducting properties. The addition of the PAES in the CTL even at 5% concentration, essentially resulted in a photo-insulator for a dual layer negatively charging system.

Polyaryletherketones were blended with polycarbonate-A in the CTL, which further comprised either TPD or DEH charge transport materials. Initial experiments involved using a 75/25 weight ratio of polycarbonate-A (PC-A) and the polyaryletherketone. The drums containing the PC-A/PAEK blends exhibited photoconductive properties. However, the drums had somewhat lower sensitivity than a control drum based on PC-A. The polymer appeared to phase separate from the PC-A binder, and resulted in crystallization of the polymer on the drum surface. The surface of the drum appeared very coarse and rough. A highly coarse drum is preferably not used in a printer, as it can severely affect the cleaning properties of a cleaning blade, thereby leaving toner on the drum. This can in turn lead to severe background and print-quality defects.

Table 9 shows effects of adding PAEK in the CTL. The CGL was a 40% HOSq in a mixture of BX-55Z/epoxy resin (25/75), and the charge transfer molecule (CTM) used was DEH (40%).

TABLE 9

Initial electricals for drums having a CTL containing PAEK and 40% DEH and a CGL containing HOSq (222 ms, expose to develop)

| Binder | Mn | PC-A/ PAEK | Charge voltage (−Vo) | $V_{0.21\mu J/cm^2}$ | $V_{0.42\mu J/cm^2}$ | Residual voltage (−Vr) |
|---|---|---|---|---|---|---|
| PC-A | 34K | 100/0 | −601.00 | −333.00 | −131.00 | −119.00 |
| P(BPZ-ketone) | 70K | 75/25 | −597.00 | −352.00 | −170.00 | −157.00 |
| P(Phenolph-ketone) | 40K | 75125 | −600.00 | −336.00 | −157.00 | −141.00 |
| P(Fluorenyl-ketone) | 17K | 75/25 | −600.00 | −312.00 | −90.00 | −78.00 |

$V_{0.21\mu J/cm^2}$ = Voltage at 0.21 $\mu J/cm^2$; $V_{0.42\mu J/cm^2}$ = Voltage at 0.42 $\mu J/cm^2$ The effect of the PAEK was then studied in photoconductors having a TiOPc based CGL. The CTL binder comprised 75% PC-A and 25% PAEK and the CGL contained a 45% type IV TiOPc and 55% BX-55Z polyvinylbutyral. Electricals are given below in Table 10, measured using a 76 ms expose-to-develop time.

TABLE 10

Initial electricals for drums having a CTL containing 40% DEH in PC-A/PAEK (75/25) and a CGL containing TiOPc.

| Binder | Mn | PC-A/ PAEK | Charge voltage (−Vo) | $V_{0.21\mu J/cm^2}$ | $V_{0.42\mu J/cm^2}$ | Residual voltage (−Vr) |
|---|---|---|---|---|---|---|
| PC-A | 34K | 100/0 | −850.00 | −450.00 | −230.00 | −130.00 |
| P(BPZ-ketone) | 25K | 75/25 | −850.00 | −465.00 | −275.00 | −215.00 |
| P(Phenolph-ketone) | 40K | 75/25 | −850.00 | −550.00 | 430.00 | −360.00 |

$V_{0.21\mu J/cm^2}$ = Voltage at 0.21 $\mu J/cm^2$; $V_{0.42\mu J/cm^2}$ = Voltage at 0.42 $\mu J/cm^2$ In a TiOPc/DEH system, the addition of the PAEK in the CTL increased the residual voltage at both the lower and higher laser energy, and in effect decreased the sensitivity of the system. The drum surface was rough, possibly indicating a phase separation of the PAEK from the PC-A matrix. Polycarbonate-Z (PC-Z) helps alleviate crystallization of transport material. While not being bound by theory, it is believed this may be attributed to the cyclohexylidene group present in the PC-Z, which is a cardo group and has a higher free volume than an isopropylidene group present in PC-A. As PC-Z is less crystalline than PC-A, the possible use of PC-Z with PAEK may result in lowering or eliminating crystallization/phase separation of PAEK. Formulations based on PC-Z/PAEK (75/25 blend ratio) gave results similar to PC-A/PAEK. The effect of molecular weight was also studied. The crystallization/phase separation was observed at molecular weights ranging from 2–120K daltons.

However, the use of lower concentrations of PAEK, such as from about 1% to about 14%, by weight of binder blend, was found to result in coating quality similar to a control drum (pure PC-A), and the resulting electricals for this PC-A/PAEK was similar to a control (PC-A) drum. Most preferably, the weight ratio of PC-A/PAEK in the binder blend was about 93:7 (referred to as a 7% binder blend). On increasing the PAEK concentration to 14% (PC-A/PAEK: 86/14 w/w), the residual voltage was found to increase and the resulting drum was slower than a PC-A control drum, although still acceptable. Initial electricals for a drum having a CTL containing PC-A/PAEK at a 7% and 14% binder blend and 30% TPD are presented in Table 11.

TABLE 11

Effect of PAEK concentration on initial electricals for drums having a CGL containing 45% TiOPc/55% BX-55Z and a CTL containing PC-A/PAEK and 30% TPD transport system (76 ms, expose-to-develop)

| Binder | Mn | PC-A/ PAEK | coat weight ($mg/in^2$) | Charge voltage (−Vo) | $V_{0.21\mu J/cm^2}$ | $V_{0.42\mu J/cm^2}$ | Residual voltage (−Vr) |
|---|---|---|---|---|---|---|---|
| PC-A | 34K | 100/0 | 14.71 | −852 | −322 | −137 | −77 |
| PC-A | 34K | 100/0 | 17.25 | −848 | −398 | −174 | −125 |
| P(BPA-ketone) | 11K | 93/7 | 13.12 | −849 | −355 | −201 | −152 |
| P(BPA-ketone) | 11K | 86/14 | 15.84 | −848 | −462 | −396 | −382 |
| P(BPZ-ketone) | 12K | 93/7 | 14.67 | −848 | −361 | −174 | −115 |
| P(BPZ-ketone) | 12K | 86/14 | 17.22 | −851 | −364 | −232 | −180 |
| P(Fluorenyl-ketone) | 11K | 93/7 | 15.36 | −847 | −343 | −178 | −122 |
| P(Fluorenyl-ketone) | 11K | 86/14 | 18.66 | −848 | −439 | −365 | −338 |

$V_{0.21\mu J/cm^2}$ = Voltage at 0.21 $\mu J/cm^2$; $V_{0.42\mu J/cm^2}$ = Voltage at 0.42 $\mu J/cm^2$ The addition of PAEK affects the initial electrical sensitivity. In most cases, at a 7% PAEK level the electricals are about 40V higher and about 50–200V for the 10% PAEK concentration. The presence of cardo groups such as cyclohexylidene, fluorenylidene groups helps improve the initial sensitivity, whereas groups such as isopropylidene increase the residual voltage and make the drum slower. Preferably the binder blend comprises no more than about 15% PAEK. Preferably the ratio of polycarbonate to PAEK is from about 99:1 to about 85:15.

Example F

The effect of the PAEK on the print-performance of the photoconductor drum was evaluated by life-testing the drums in a Lexmark Optra-S 2450 laser printer. For a stable print performance, the photoconductor drum should exhibit minimum fatigue, and the prints at the start and end-of-life should be similar or have minimal change. One method for tracking the stable print-perfornance is to evaluate the gray scale pattern in a 1200 dpi (dots-per-inch). This corresponds to a systematic change in a gray scale page from an all-black to white through a series of 128 boxes corresponding to various shades of gray (WOB, White-on-Black). For a stable print-performance, the box corresponding to the start of life gray scale should be similar to that at the end-of-life.

Table 12 illustrates the effect of the PAEK on the print stability of the photoconductor drum.

TABLE 12

Life-test results for drums having a CTL containing PC-A/PAEK and TPD in an Optra S 2450 printer

| PAEK | Mn | PC-A/ PAEK | C. Wt. | P. Ct. | CV (−Vo) | SV | DV | WOB | OD |
|---|---|---|---|---|---|---|---|---|---|
| Nil | 34K | 100/0 | 15.93 | 24.lK | −823/ −788 | −413/ −412 | −107/ −91 | 13/24 | 0.87/ 0.90 |
| P(BPA-ketone) | 34K | 100/0 | 13.43 | 29.9K | −881/ −832 | −541/ −560 | −177/ −215 | 4/7 | 0.38/ 0.40 |
| P(BPZ-ketone) | 11K | 93/7 | 15.75 | 25.2K | −832/ −838 | −453/ −473 | −159/ −146 | 12/16 | 0.64/ 0.72 |
| P(FluoBP-ketone) | 11K | 93/7 | 15.66 | 28.7K | −861/ −861 | −490/ −530 | −176/ −194 | 8/10 | 0.50/ 0.57 |
| P(BPZ-ketone) | 12K | 86/14 | 16.42 | 30.0K | −806/ −832 | −469/ −502 | −248/ −213 | 9/14 | 0.44/ 0.54 |

Mn = number average molecular weight; C. Wt. = coat weight (mg/in$^2$); P. Ct. = page count; CV = charge voltage; SV = streak voltage; DV = discharge voltage; WOB = white on black; OD = Isopel OD start/avg.

The data in Table 12 indicates that the WOB value, which relates to resolution of prints in a graphic mode, was improved by the addition of a PAEK to polycarbonate solution. The stable print-performance of the PC-A/PAEK system, in turn results in higher page yield, for the same amount of toner. The use of co-polymers containing at least one group as a isopropylidene group and at least one cardo group such as cyclohexyl, fluorenyl or phthalidenyl may exhibit better performance than a homopolymer. The cyclic groups can help achieve electricals similar to a control (PC-A) and the isopropylidene group can give stable print-performance, as evident from Table 12.

Although some polycarbonate charge transport solutions, such as charge transport solutions containing polycarbonate (PC-Z), may have acceptable pot-lives, others do not. For example, PC-A based charge transport solutions are susceptible to gelation due to the crystalline nature of PC-A. The addition of a PAEK extends the pot-life of such solutions.

Example G

Additional prior art comparative examples and example photoconductors in accordance with the invention are set forth below. Charge generation formulations comprising a squaraine pigment/binder weight ratio 40/60 were prepared for photoconductor drums as follows in Comparative Examples 1 and 2, photoconductor drums of the prior art, and Examples 1 and 2, photoconductor drums in accordance with the invention.

Comparative Example 1

Hydroxysquaraine (4.0 g), polyvinylbutyral (BX-55Z, Sekisui Chemical Co., 6.0 g) with Potter's glass beads (60 ml) was added to tetrahydrofuran (33 g) and cyclopentanone (15.0 g), in an amber glass bottle, and agitated in a paint-shaker for 12 h and diluted to about 6% solids with 2-butanone (118 g). An anodized aluminum drum was then dip-coated with the CG formulation and dried at 100° C. for 5 min. The transport layer formulation was prepared from a bisphenol-A polycarbonate (MAK-5208, Bayer, 62.30 g), benzidine (26.70 g) in tetrahydrofuran (THF, 249 g) and 1,4-dioxane (106 g). The CG layer coated drum was dip-coated in the CT formulation, dried at 120° C. for 1 hour, to obtain a coat weight of about 19.43 mg/in$^2$. The electrical characteristics of this drum were: charge voltage (Vo): −602V, V(0.21 $\mu$J/cm$^2$): −390V, V(0.42 $\mu$J/cm2): −275V, residual voltage (Vr): −109V and dark decay (28V/sec) (OD: 1.25).

Comparative Example 2

Hydroxysquaraine (4.0 g), poly(bisphenol-A-benzophenone (6.0 g) with Potter's glass beads (60 ml) was added to tetrahydrofuran (33 g) and cyclopentanone (15.0 g), in an amber glass bottle, and agitated in a paint-shaker for 12 h and diluted to about 6% solids with 2-butanone (118 g). An anodized aluminum drum was then dip-coated with the CG formulation and dried at 100° C. for 5 min. The transport layer formulation was prepared from a bisphenol-A polycarbonate (MAK-5208, Bayer, 62.30 g), benzidine (26.70 g) in tetrahydroftran (THF, 249 g) and 1,4-dioxane (106 g). The CG layer coated drum was dip-coated in the CT formulation and dried at 120° C. for 1 hour to obtain a coat weight of about 16.54 mg/in$^2$. The electrical characteristics of this drum were: charge voltage (Vo): −603V, V(0.21 $\mu$J/cm$^2$): −376V, V(0.42 $\mu$J/cm$^2$): −246V, residual voltage (Vr): −125V and dark decay (49V/sec) (OD: 1.22).

Example 1

Hydroxysquaraine (4.0 g), polyvinylbutyral (BX-55Z, 4.5 g) and poly(bisphenol-A-benzophenone (1.5 g) with Potter's glass beads (60 ml) was added to tetrahydrofuran (33 g) and cyclopentanone (15.0 g), in an amber glass bottle, and agitated in a paint-shaker for 12 h and diluted to about 6% solids with 2-butanone (118 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 20.35 mg/in$^2$. The electrical characteristics of this drum were: charge voltage (Vo): −601V, V(0.21 $\mu$J/cm$^2$): −350V, V(0.42 $\mu$J/cm$^2$): −214V, residual voltage (Vr): −96V and dark decay (41V/sec) (OD: 1.22).

Example 2

Hydroxysquaraine (4.0 g), polyvinylbutyral (BX-55Z, 1.5 g) and poly(bisphenol-A-benzophenone (4.5 g) with Potter's glass beads (60 ml) was added to tetrahydrofuran (33 g) and cyclopentanone (15.0 g), in an amber glass bottle, and agitated in a paint-shaker for 12 h and diluted to about 6% solids with 2-butanone (118 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 18.18 mg/in$^2$. The electrical characteristics of this drum were: charge voltage (Vo): −601V, V(0.21 $\mu$J/cm$^2$): −370V, V(0.42 $\mu$J/cm$^2$): −224V, residual voltage (Vr): −72V and dark decay (12V/sec) (OD: 1.08).

Charge generation formulations comprising a squaraine pigment/binder weight ratio at 30/70 were prepared for photoconductor drums as follows in Comparative Example 3, a prior art photoconductor drum and Examples 3–5, photoconductor in accordance with the invention.

Comparative Example 3

Hydroxysquaraine (1.2 g), polyvinylbutyral (BX-55Z, Sekisui Chemical Co., 2.80 g) with Potter's glass beads (20 ml) was added to tetrahydrofuran (33 g), in an amber glass bottle, and agitated in a paint-shaker for 12 h and diluted to about 3% solids with terahydrofuiran (86 g) and cyclohexanone (13 g). An anodized aluminum drum was then dip-coated with the CG formulation and dried at 100° C. for 5 min. The transport layer formulation was prepared from a bisphenol-A polycarbonate (MAK-5208, Bayer, 62.30 g), benzidine (26.70 g) in tetrahydrofuran (THF, 249 g) and 1,4-dioxane (106 g). The CG layer coated drum was dip-coated in the CT formulation and dried at 120° C. for 1 hour to obtain a coat weight of about 18.82 mg/in$^2$. The electrical characteristics of this drum were: charge voltage (Vo): −596V, V(0.42 $\mu$J/cm$^2$): −464V, V(1.0 $\mu$J/cm$^2$): −368V, residual voltage (Vr): −305V (OD: 1.07).

Example 3

Hydroxysquaraine (2.0 g), poly(bisphenol-A-phenylsulfone (2.33 g) and polyvinylbutyral (BX-55Z, 2.33 g ) with Potter's glass beads (20 ml) was added to tetrahydrofuran (55.5 g), in an amber glass bottle, and agitated in a paint-shaker for 12 h and diluted to about 4% solids with tetrahydrofuran (88 g) and cyclohexanone (16 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 17.62 mg/in$^2$. The electrical characteristics of this drum were: charge voltage (Vo): −598V, V(0.42 $\mu$J/cm$^2$): −455V, V(1.0 $\mu$J/cm$^2$): −332V, residual voltage (Vr): −250V (OD: 1.03).

Example 4

Hydroxysquaraine (4.0 g), polyvinylbutyral (BX-55Z, 2.33 g) and poly(cyclohexylidenebisphenol-phenylsulfone) (2.33 g) with Potter's glass beads (20 ml) was added to tetrahydrofuran (55.5 g), in an amber glass bottle, and agitated in a paint-shaker for 12 h and diluted to about 4% solids with tetrahydrofuran (88 g) and cyclohexanone (16 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 18.11 mg/in$^2$. The electrical characteristics of this drum were: charge voltage (Vo): −599V, V(0.42 $\mu$J/cm$^2$): −392V, V(1.0 $\mu$J/cm$^2$): −248V, residual voltage (Vr): −164V (OD: 1.11).

Example 5

Hydroxysquaraine (4.0 g), polyvinylbutyral (BX-55Z, 2.33 g) and poly(phenolphthalein-phenylsulfone (2.33 g) with Potter's glass beads (20 ml) was added to tetrahydrofuran (55.5 g), in an amber glass bottle, and agitated in a paint-shaker for 12 h and diluted to about 6% solids with tetrahydrofuran (88 g) and cyclohexanone (16 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 18.80 mg/in$^2$. The electrical characteristics of this drum were: charge voltage (Vo): −600V, V(0.42 $\mu$J/cm$^2$): −430V, V(1.0 $\mu$J/cm$^2$): −294V, residual voltage (Vr): −204V (OD: 1.07).

Charge generation formulations consisting of a titanyl phthalocyanine pigment/binder weight ratio 45/55 were prepared for photoconductor drums as follows in Comparative Example 5–6, photoconductor drums of the prior art, and Examples 6–8, photoconductor drums in accordance with the present invention:

Comparative Example 4

Oxotitanium phthalocyanine (7.0 g), polyvinylbutyral (BX-55Z, Sekisui Chemical Co., 9.1 g) with Potter's glass beads (50 ml) was added to tetrahydrofuran (80 g), in an amber glass bottle, and agitated in a paint-shaker for 12 h and diluted to about 6.5% solids with 2-butanone (152 g). An anodized aluminum drum was then dip-coated with the CG formulation and dried at 100° C. for 5 min. The transport layer formulation was prepared from a bisphenol-A polycarbonate (MAK-5208, Bayer, 62.30 g), benzidine (26.70 g) in tetrahydroflran (THF, 249 g) and 1,4-dioxane (106 g). The CG layer coated drum was dip-coated with the transport layer formulation of Comparative Example 1 and dried at 120° C. for 1 hour to obtain a coat weight of about 16.40 mg/in2. The electrical characteristics of this drum were: charge voltage (Vo): −698V, V(0.21 $\mu$J/cm$^2$): −212V, V(0.42 $\mu$J/cm$^2$): −144V, residual voltage (Vr): −109V and dark decay (38V/sec) (OD: 1.55).

Comparative Example 5

Oxotitanium phthalocyanine (7.0 g), poly(bisphenol-A-benzophenone) (9.1 g) with Potter's glass beads (50 ml) was added to tetrahydrofuran (80 g), in an amber glass bottle, and agitated in a paint-shaker for 12 h and diluted to about 6.5% solids with 2-butanone (152 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 15.88 mg/in$^2$. The electrical characteristics of this drum were: charge voltage (Vo): −700V, V(0.21 $\mu$J/cm$^2$): −182V, V(0.42 $\mu$J/cm$^2$): −133V, residual voltage (Vr): −114V and dark decay (23V/sec) (OD: 1.43).

Comparative Example 6

Oxotitanium phthalocyanine (7.0 g), polyBhenolphthalein-benzophenone) (9.1 g) with Potter's glass beads (50 ml) was added to tetrahydrofuran (80 g), in an amber glass bottle, and agitated in a paint-shaker for 12 h and diluted to about 6.5% solids with 2-butanone (152 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 15.88 mg/in$^2$. The electrical characteristics of this drum were: charge voltage (Vo): −699V, V(0.21 $\mu$J/cm$^2$): −313V, V(0.42 $\mu$J/cm$^2$): −248V, residual voltage (Vr): −199V and dark decay (58V/sec) (OD: 1.50).

Example 6

Oxotitanium phthalocyanine (7.0 g), polyvinylbutyral (BX-55Z, 6.83 g), poly(phenolphthalein-benzophenone) (2.27 g) with Potter's glass beads (50 ml) was added to tetrahydrofuran (80 g), in an amber glass bottle, and agitated in a paint-shaker for 12 h and diluted to about 4.5% solids with 2-butanone (262 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 17.14 mg/in$^2$. The electrical characteristics of this drun were: charge voltage (Vo): −700V, V(0.21 $\mu$J/cm$^2$): −163V, V(0.42 $\mu$J/cm$^2$): −124V, residual voltage (Vr): −97V and dark decay (29V/sec) (OD: 1.38).

Example 7

Oxotitanium phthalocyanine (7.0 g), polyvinylbutyral (BX-55Z, 6.83 g), poly(bisphenol-A-benzophenone) (2.27 g) with Potter's glass beads (50 ml) was added to tetrahydrofuran (80 g), in an amber glass bottle, and agitated in a paint-shaker for 12 h and diluted to about 4.5% solids with 2-butanone (262 g). An anodized aluminum drum was then dipcoated with the CG formulation and dried at 100° C. for 5 min. The CG layer coated drum was dip-coated with the transport layer formulation of Comparative Example 1 and dried to obtain a coat weight of about 17.14 mg/in$^2$. The electrical characteristics of this drum were: charge voltage (Vo): −697V, V(0.21 $\mu$J/cm$^2$): −141V, V(0.42 $\mu$J/cm$^2$): −109V, residual voltage (Vr): −90V and dark decay (36V/sec) (OD: 1.37).

Example 8

Oxotitanium phthalocyanine (7.0 g), polyvinylbutyral (BX-55Z, 6.83 g), poly(cyclohexylidenebisphenol-benzophenone) (2.27 g) with Potter's glass beads (50 ml) was added to tetrahydrofuran (80 g), in an amber glass bottle, and agitated in a paint-shaker for 12 h and diluted to about 4.5% solids with 2-butanone (262 g). An anodized aluminum drum was then dip-coated with the CG formulation and dried at 100° C. for 5 min. The CG layer coated drum was dip-coated with the transport layer formulation of Comparative Example 1 and dried to obtain a coat weight of about 15.99 mg/in$^2$. The electrical characteristics of this drum were: charge voltage (Vo): −698V, V(0.21 $\mu$J/cm$^2$): −132V, V(0.42 $\mu$J/cm2): −94V, residual voltage (Vr): −79V and dark decay (29V/sec) (OD: 1.48).

Comparative Examples 7 and 8 are photoconductor drums comprising a prior art charge transport layer, while Examples 9–13 are photoconductor drums comprising charge transport layers in accordance with the invention.

Comparative Example 7

A standard 45/55 type IV oxotitanium phthalocyanine (4.5 g) and polyvinylbutyral (5.5 g)in a mixture of 2-butanone/cyclohexanone (90/10) at 3% solids was used to coat an anodized aluminum drum, and dried at 100° C. for 15 min. A transport solution corresponding to bisphenol-A polycarbonate (Makrolon-5208, 56 g), TPD (24 g) were dissolved in THF (240 g) and 1,4-dioxane (80 g), with a surfactant (DC-200, 6 drops). The anodized drum previously coated with a CG layer was dip-coated with the transport solution and was dried at 120° C. for 1 hour to obtain a coat weight of 14.53 mg/in$^2$. The electrical characteristics of this drum were: charge voltage (Vo): −852V; voltage (0.21 $\mu$J/cm$^2$): −322V, voltage (0.42 $\mu$J/cm$^2$): −129V, residual voltage: −77V.

Example 9

A standard 45/55 type IV oxotitanium phthalocyanine (4.5 g) and polyvinylbutyral (5.5 g) in a mixture of 2-butanone/cyclohexanone (90/10) at 3% solids was used to coat an anodized aluminum drum, and was dried at 100° C. for 15 min. A transport solution corresponding to bisphenol-A polycarbonate (Makrolon-5208, 52 g), poly (bisphenol-A-benzophenone) (4.0 g) and TPD (24 g) were dissolved in THF (240 g) and 1,4-dioxane (80 g), with a surfactant (DC-200, 6 drops). The anodized drum previously coated with a CG layer was dip-coated with the transport solution and was dried at 120° C. for 1 hour to obtain a coat weight of 13.43 mg/in$^2$. The electrical characteristics of this drum were: charge voltage (Vo): −849V; voltage (0.21 $\mu$J/cm$^2$): −355V, voltage (0.42 $\mu$J/cm$^2$): −201V, residual voltage: −152V.

Example 10

A standard 45/55 type IV oxotitanium phthalocyanine (4.5 g) and polyvinylbutyral (5.5 g) in a mixture of 2-butanone/cyclohexanone (90/10) at 3% solids was used to coat an anodized aluminum drum, and was dried at 100° C. for 15 min. A transport solution corresponding to bisphenol-A polycarbonate (Makrolon-5208, 52 g), poly (cyclohexylidenebisphenol-benzophenone) (4.0 g) and TPD (24 g) were dissolved in THF (240 g) and 1,4-dioxane (80 g), with a surfactant (DC-200, 6 drops). The anodized drum previously coated with a CG layer was dip-coated with the transport solution, and was dried at 120° C. for 1 hour to obtain a coat weight of 14.67 mg/in$^2$. The electrical characteristics of this drum were: charge voltage (Vo): −848V; voltage (0.21 $\mu$J/cm$^2$): −361V, voltage (0.42 $\mu$J/cm$^2$): −174V, residual voltage: −115V.

Example 11

A standard 45/55 type IV oxotitanium phthalocyanine (4.5 g) and polyvinylbutyral (5.5 g) in a mixture of 2-butanone/cyclohexanone (90/10) at 3% solids was used to coat an anodized aluminum drum, and was dried at 100° C. for 15 min. A transport solution corresponding to bispheinol-A polycarbonate (Makrolon-5208, 52 g), poly (fluorenylidenebisphenol-benzophenone) (4.0 g) and TPD (24 g) were dissolved in THF (240 g) and 1,4-dioxane (80 g), with a surfactant (DC-200, 6 drops). The anodized drum previously coated with a CG layer was dip-coated with the transport solution, and was dried at 120° C. for 1 hour to obtain a coat weight of 15.36 mg/in$^2$. The electrical characteristics of this drum were: charge voltage (Vo): −847V; voltage (0.21 $\mu$J/cm$^2$): −343V, voltage (0.42 $\mu$J/cm$^2$): −178V, residual voltage: −122V.

Example 12

A standard 45/55 type IV oxotitanium phthalocyanine (4.5 g) and polyvinylbutyral (5.5 g) in a mixture of 2-butanone/cyclohexanone (90/10) at 3% solids was used to coat an anodized aluminum drum, and was dried at 100° C.

for 15 min. A transport solution corresponding to bisphenol-A polycarbonate (Makrolon-5208, 52 g), poly (cyclohexylidenebisphenol-benzophenone) (8.66 g) and TPD (26 g) were dissolved in THF (240 g) and 1,4-dioxane (80 g), with a surfactant (DC-200, 6 drops). An anodized drum previously coated with a CG layer was dip-coated with the transport solution and was dried at 120° C. for 1 hour to obtain a coat weight of 15.84 mg/in$^2$. The electrical characteristics of this drum were: charge voltage (Vo): −851V; voltage (0.21 $\mu$J/cm$^2$): −364V, voltage (0.42 $\mu$J/cm$^2$): −232V, residual voltage: −180V.

Comparative Example 8

A standard 45/55 type IV oxotitanium phthalocyanine (4.5 g) and polyvinylbutyral (5.5 g) in a mixture of 2-butanone/cyclohexanone (90/10) at 3% solids was used to coat an anodized aluminum drum, and was dried at 100° C. for 15 min. A transport solution corresponding to bisphenol-A polycarbonate (Makrolon-5208, 18 g), and DEH (12 g), Savinyl Yellow (0.2 g) were dissolved in THF (90 g) and 1,4-dioxane (30 g), with a surfactant (DC-200, 3 drops). An anodized drum previously coated with a CG layer was dip-coated with the transport solution, and was dried at 120° C. for 1 hour to obtain a coat weight of 17.48 mg/in$^2$. The electrical characteristics of this drum were: charge voltage (Vo): −848V; voltage (0.21 $\mu$J/cm$^2$): −361V, voltage (0.42 $\mu$J/cm)$^2$.−174V, residual voltage: −115V.

Example 13

A standard 45/55 type IV oxotitanium phthalocyanine (4.5 g) and polyvinylbutyral (5.5 g) in a mixture of 2-butanone/cyclohexanone (90/10) at 3% solids was used to coat an anodized aluminum drum, and was dried at 100° C. for 15 min. A transport solution corresponding to bisphenol-A polycarbonate (Makrolon-5208, 16.74 g), poly (cyclohexylidene-bisphenol-benzophenone-bisphenol-A) (1.26 g) and DEH (12 g), Savinyl Yellow (0.2 g) were dissolved in THF (90 g) and 1,4-dioxane (30 g), with a surfactant (DC-200, 3 drops). An anodized drum previously coated with a CG layer was dip-coated with the transport solution, and was dried at 120° C. for 1 hour to obtain a coat weight of 14.70 mg/in$^2$. The electrical characteristics of this drum were: charge voltage (Vo): −847V; voltage (0.21 $\mu$J/cm$^2$): −413V, voltage (0.42 $\mu$J/cm$^2$): −200V, residual voltage: −121V.

PAEK-hydrazones and PAEK-azines

Example H

The modification of a ketone to the corresponding hydrazone or azine was accomplished by the condensation of a PAEK with either a hydrazine, 1,1-diphenylhydrazine hydrochloride, or a hydrazone, 9-fluorenone hydrazone, respectively. The pre-polymers (PAEKs) were synthesized by the aromatic nucleophilic displacement reaction of difluorobenzophenone using various potassium bisphenolates in N,N-dimethylacetamide solvent, as discussed above. All polymers were isolated by precipitation in water and the resulting polymer was chopped in a high speed blender. Typical work-up included the steps of stirring the off-white fibrous polymer in water, neutralizing with aqueous acid (~5% HCl), filtering, stirring in boiling water for about one hour, filtering, stirring in boiling methanol for about 0.5 hours, filtering and drying at 100° C. for about 16 hours in a vacuum oven. The yield for the polymerization was about 90%. In the case of co-polymers, appropriate amounts of two or more bisphenols were used, and the polymerization procedure was similar to the one outlined above.

In order to prepare the PAEK-hydrazones, poly (bisphenol-A-benzophenone) (5.0000 g, Mn~11214, 12.30 mmol), 1,1-diphenylhydrazine hydrochloride (2.714 g, 12.30 mmol), tetrahydrofuran (18 g), N,N-dimethylacetamide (18 g) was weighed into a 150 ml single neck round bottom flask. The flask was fitted with a condenser, and stirred with a magnetic stirrer. On complete dissolution of the polymer and the hydrazine, methane sulfonic acid (~6 drops) was added and the solution heated to reflux. The yellow solution was heated at reflux for about 4 hours. The polymer solution was poured in water and chopped in a high speed blender. The fibrous yellow polymer was filtered, stirred in boiling water for about 45 minutes filtered, stirred in boiling methanol for about 45 minutes, filtered and dried at 100° C. for about 16 hours under vacuum. The yield was greater than about 90%.

For the preparation of PAEK-azines, 9-fluorenone hydrazone was used in place of 1,1-diphenylhydrazine hydrochloride. The reaction procedure was similar to the hydrazone synthesis, except the solution was bright orange on the addition of methanesulfonic acid.

Molecular weights of the polymers were determined using Gel Permeation Chromatography. Glass-transition temperatures were determined using a Differential Scanning Calorimeter, and is reported as the inflection point of the $\Delta T$ (temperature difference between the polymer and the reference material) and T (temperature) plot. Co-polymer ratios were obtained by $^1$H (proton) and $^{13}$C nuclear magnetic resonance (NMR) spectroscopy, and were determined by the ratios of the protons characteristic of the different monomers used.

All hydrazone polymers were isolated as yellow fibrous materials. The polymers comprised the structure:

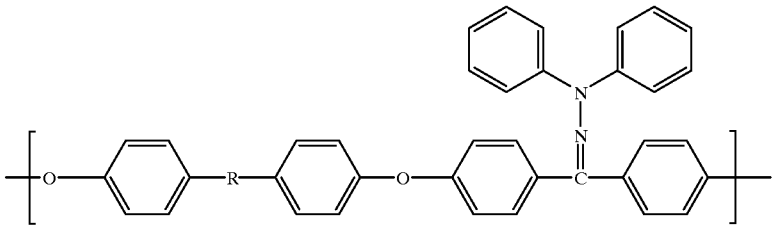

Characterizations of representative polymers are given in Table 13.

TABLE 13

Characterization of Poly(aryl ether ketone-hydrazone)s

| Polymer | R | PAEK Mn | PAEK-Hydrazone Mn | PAEK-Hydrazone Mw | PAEK-Hydrazone polyd. |
|---|---|---|---|---|---|
| Polymer I | Isopropyl | 11043 | 11837 | 22117 | 1.86 |
| Polymer II | Cyclohexyl | 12046 | 12981 | 24698 | 1.90 |
| Polymer III | cyclohexyl/ isopropyl (1:1) | 47855 | 52334 | 98090 | 1.87 |

Mn = Number average molecular weight; Mw = Weight average molecular weight; Polyd. = Polydispersity;

The PAEK-azines were isolated as orange fibrous solids, and were typically soluble in tetrahydrofaran, 1,4-dioxane and chlorinated hydrocarbons, and were partially soluble in ethyl acetate, acetone and toluene. The polymers comprised the structure:

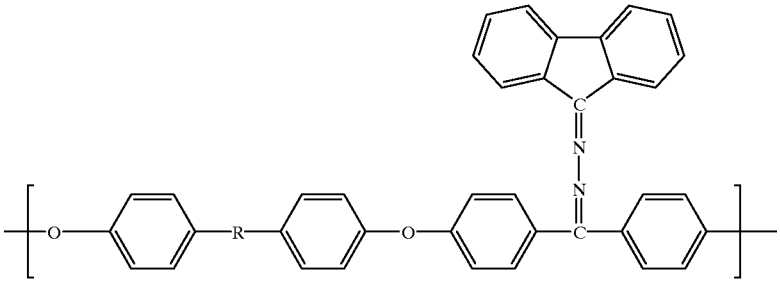

Characterizations of representative polymers are given in Table 14.

TABLE 14

Characterization of Poly(aryl ether ketone-azine)s

| Polymer | R | PAEK Mn | PAEK-Azine Mn | PAEK-Azine Mw | PAEK-Azine polyd. |
|---|---|---|---|---|---|
| Polymer V | Isopropyl | 12003 | 14846 | 37395 | 2.52 |
| Polymer VI | Cyclohexyl | 12046 | 13521 | 25827 | 1.91 |
| Polymer VII | phthalidene | 24537 | 33860 | 55623 | 1.64 |
| Polymer VIII | fluorenyl | 29335 | 31966 | 62730 | 1.96 |
| Polymer IX | isopropyl, R1 = CH3 | 8244 | 11837 | 27352 | 2.31 |

Mn = Number average molecular weight; Mw = Weight average molecular weight; Polyd. = Polydispersity;

From Tables 13 and 14, the conversion of the ketone groups of the PAEK to the azine is about 25%. The polymers are, therefore, a co-polymer of a ketone and the azine pendant.

Several particular synthesis reactions are set forth below:

Poly(bisphenol-A-benzophenone-fluorenone azine)

In a 100 mL single neck round bottom flask was weighed poly(bisphenol-A-benzophenone) (4.0000 g, 9.84 mmol), 9-fluorenone hydrazone (1.9113 g, 9.84 mmol), tetrahydrofuran (THF, 32 g) and N,N-dimethylacetamide (6 g). The flask was fitted with a condensor. The yellow slurry was stirred with a magnetic stirrer until dissolved. To the yellow solution was added methanesulfonic acid (6 drops), and the solution heated to reflux. After stirring for about 4 hours, the orange solution was precipitated in water, and chopped in a high speed blender. The orange fibrous polymer was isolated by filtration, washed in boiling water (about 45 min.), filtered, washed in boiling methanol (about 45 min.), filtered and dried at 100° C. for about 16 hours. The yield was about 4.31 g. The number average molecular weight of the polymer was about 14.8K.

Poly(fluorenylidenebisphenol-benzophenone-fluorenone azine)

In a 100 mL single neck round bottom flask was weighed poly(fluorenylidenebisphenol-benzophenone) (6.0000 g, 15.60 mmol), 9-fluorenone hydrazone (3.031 g, 15.60 mmol), THF (32 g) and N,N-dimethylacetamide (11 g). The flask was fitted with a condensor. The yellow slurry was stirred with a magnetic stirrer until the solids dissolved. To the yellow solution was added methanesulfonic acid (6 drops), and the solution heated to reflux. After stirring for about 4 hours, the orange solution was precipitated in water, and chopped in a high speed blender. The orange fibrous polymer was isolated by filtration, washed in boiling water (45 min.), filtered, washed in boiling methanol (45 min.), filtered and dried at 100° C. for about 16 hours. The yield was about 6.43 g. The number average molecular weight of the polymer was about 31.9K.

Poly(phenolphthalein-benzophenone-fluorenone azine)

In a 100 mL single neck round bottom flask was weighed poly(phenolphthalein-benzophenone) (6.0000 g, 12.48 mmol), 9-fluorenone hydrazone (3.031 g, 15.60 mmol), THF (20 g) and N,N-dimethylacetamide (20 g). The flask was fitted with a condensor. The yellow slurry was stirred with a magnetic stirrer to dissolve the solids. To the yellow solution was added methanesulfonic acid (about 6 drops), and the solution heated to reflux. After stirring for about 4 hours, the orange reaction solution was precipitated in water, and chopped in a high speed blender. The orange fibrous polymer was isolated by filtration, washed in boiling water (about 45 min.), filtered, washed in boiling methanol (about 45 min.), filtered and dried at about 100° C. for about 16 hours. The yield was about 6.78 g. The number average molecular weight of the polymer was about 33.8K.

Poly(bisphenol-A-benzophenone-diphenylhydrazone)

In a 100 mL single neck round bottom flask was weighed poly(bisphenol-A-benzophenone) (5.000 g, 11.50 mmol), 1,1-diphenylhydrazine hydrochloride (2.714 g, 12.30 mmol), THF (18 g) and N,N-dimethylacetamide (18 g). The flask was fitted with a condenser. The dark slurry was stirred with a magnetic stirrer to dissolve the starting materials. To the dark solution was added methanesulfonic acid (about 6 drops), and the solution heated to reflux . After stirring for about 4 hours, the orange polymer solution was precipitated in water, and chopped in a high speed blender. The yellow fibrous polymer was isolated by filtration, washed in boiling water (about 45 min.), filtered, washed in boiling methanol (about 45 min.), filtered and dried at about 100° C. for about 16 hours. The yield was about 5.29 g. The number average molecular weight of the polymer was about 11.8K.

Poly(cyclohexylidenebisphenol-benzophenone-diphenylhydrazone)

Poly(cyclohexylidenebisphenol-benzophenone-diphenylhydrazone) was synthesized from poly (cyclohexylidenebisphenol-benzophenone) (5.000 g, 11.19 mmol), 1,1-diphenylhydrazine hydrochloride (2.47 g, 11.19 mmol), THF (18 g) and N,N-dimethyl acetamide (18 g) in a manner similar to poly(bisphenol-A-benzophenone-diphenylhydrazone). The yield was about 5.74 g. The number average molecular weight of the polymer was about 12.9K.

Poly(cyclohexylidenebisphenol-benzophenone-diphg h drazone-bisphenol-A (50/50)

Poly(cyclohexylidenebisphenol-benzophenone-diphenylhydrazone-bisphenol-A) was synthesized frompoly (cyclohexylidenebisphenol-benzophenone-bisphenol-A) (5.000 g, 5.86 mmol), 1,1-diphenylhydrazine hydrochloride (2.58 g, 11.72 mmol), THF (17 g) and N,N-dimethyl acetamide (17 g) in a manner similar to poly(bisphenol-A-benzophenone-diphenylhydrazone). The yield was about 5.87 g. The number average molecular weight of the polymer was about 52.3K.

Example I

Charge transport layers were prepared using N,N'-bis(3-methylphenyl)-N,N'-bisphenylbenzidine (TPD). In a typical case, the CTL binder was a 90/10 w/w ratio blend of polycarbonate (PC-A) and the PAEK-azine, with 30% TPD concentration. The transport layer was coated on top of a CG layer comprising 45% type IV TiOPc and 55% polyvinylbutyral (BX-55Z). The initial electricals for the PC-A/PAEK-azines are given in Table 15.

TABLE 15

Initial electricals for drums having a CTL containing 30% TPD in PC-A/PAEK-azine blends in a TPD CTL, electricals measured at 76 ms expose-to-develop.

| Binder | PC-A/ PAEK-Azine | C. Wt. | Charge voltage (−Vo) | $V_{0.21\mu J/cm^2}$ | $V_{0.42\mu J/cm^2}$ | Residual voltage (−Vr) |
|---|---|---|---|---|---|---|
| PC-A | 100/0 | 17.71 | −850 | −330 | −185 | −131 |
| P(BPA-azine) | 90/10 | 16.91 | −850 | −343 | −192 | −136 |
| P(Fluorenyl BP-azine) | 90/10 | 16.85 | −846 | −345 | −207 | −149 |
| P(Phthalidenyl-azine) | 90/10 | 16.93 | −851 | −363 | −207 | −140 |

C. Wt. = coat weight (mg/in$^2$); $V_{0.21\mu J/cm^2}$ = Voltage at 0.21 $\mu$J/cm$^2$; $V_{0.42\mu J/cm^2}$ = Voltage at 0.42 $\mu$J/cm$^2$ The addition of the PAEK-azine to the TPD transport does not adversely affect the initial electricals of the TPD system. The coating quality for the PAEK-azine blends was similar to the control (PC-A). Typically use of PAEK at a 7% dopant level increased the residual voltage of the photoconductor somewhat. In contrast, use of PAEK-azines at a 10% dopant level increased the residual voltage by only 10V.

Example J

The effect of the PAEK-azine on the print-performance of the photoconductor drum was evaluated by life-testing the drums in a Lexmark Optra-S 2450 laser printer. For stable print-performance, the box corresponding to the start of life gray scale should be similar to that at the end-of-life. Table 16, set forth below, illustrates the effect of the PAEK-azine on the print stability of the photoconductor drum.

TABLE 16

Life-test results for drums having a CTL containing PC-A or a PC-A/PAEK-azine blend and 30% TPD.

| Binder | PC-A/ PAEK-azine | C. Wt. | P. Ct. | Print Usage | CV (−Vo) | SV | DV | WOB | OD |
|---|---|---|---|---|---|---|---|---|---|
| PC-A | 100/0 | 17.71 | 25.1 K | 17.0/ 4.3 | −881/ −801 | −452/ −401 | −165/ −133 | 14/25 | 0.72/ 0.92 |
| P(BPA-azine) | 90/10 | 16.91 | 27.4 K | 15.7/ 3.9 | −818/ −824 | −456/ −443 | −185/ −124 | 13/17 | 0.71/ 0.78 |
| P(Fluorenyl BP-azine) | 90/10 | 16.85 | 28.2 K | 14.9/ 3.9 | −887/ −853 | −529/ −564 | −156/ −186 | 8/11 | 0.44/ 0.54 |

Mn = number average molecular weight; C. Wt. = coat weight (mg/in$^2$); P. Ct. = page count; CV = charge voltage; SV = streak voltage; DV = discharge voltage; WOB = white on black; OP = Isopel OD start/avg.

Table 16 demonstrates that the print-performance fro m a PC-A/PAEK-azine drum is improved relative to a PC-A drum. The WOB (white-on-black) box appears to be more severely affected in the PC-A case, but shows a very small change for the blends. Based upon comparison of the start and end-of-life electricals, the charge voltage and streak voltage are severely affected in the PC-A case; in contrast, the blends exhibited improved stability. In the PC-A case, the prints get too dark with life, as indicated by the change in Isopel optical density from 0.75 to an average of 0.92. In contrast, the blends showed a smaller change through life. The stable print-performance of the PC-A/PAEK-azine system in turn results in higher page yield for the same amount of toner. The binder blend drums a veraged ab out 2000 more pages than the control drum (PC-A). The print usage is another tool to assess the amount of toner consumed per page. In the PC-A control drum case, the toner-to-page and toner-to-cleaner (unused toner) was 17.0 and 4.3, respectively. The drums comprising binder blends required 14.9–15.7 mg/page for the toner-to-page and only about 3.9 mg went to the cleaner. PAEK-azine copolymers give similar results.

Example K

The PAEK-hydrazones were also formulated in a transport layer, and photoconductor drums comprising the transport layer were evaluated for initial electrical performance and fatigue/electrical stability. The initial electricals given in Table 17, set forth below, correspond to a drum having a CGL containing 45% Type IV TiOPc/55% BX-55Z polyvinylbutyral, and a CTL containing 40% DEH transport in PC-A/PAEK-hydrazone blend. For illustrative purposes, a homopolymer and co-polymer were used for the initial electricals and print-test through life.

TABLE 17

Initial electricals for drums having a CTL containing PC-A/PAEK-hydrazone in 40% DEH transport (measured at 76 ms, expose-to-develop)

| Binder | PC-A/ PAEK-hydrazone | C. Wt. | CV (−Vo) | $V_{0.21\mu J/cm^2}$ | $V_{0.42\mu J/cm^2}$ | RV (−Vr) |
|---|---|---|---|---|---|---|
| PC-A | 100/0 | 27.48 | −850 | −361 | −194 | −131 |
| P(BPZ-Hydrazone) | 93/7 | 28.52 | −848 | −381 | −236 | −186 |
| P(BPZ-hydrazone-BPA) | 93/7 | 27.06 | −849 | −387 | −217 | −159 |

C. Wt. = coat weight (mg/in$^2$); CV = charge voltage; $V_{0.21\mu J/cm^2}$ = Voltage at 0.21 $\mu$J/cm$^2$; $V_{0.42\mu J/cm^2}$ = Voltage at 0.42 $\mu$J/cm$^2$; RV = residual voltage The addition of the PAEK-hydrazone did not adversely affect the initial electricals of this system.

The addition of PAEK-azines or PAEK-hydrazones increased the pot-life of a polycarbonate-containing charge transport solution about 3-fold relative to a polycarbonate-containing charge transport solution which is free of PAEK-azines and PAEK-hydrazones. The extended pot-life leads to cost-savings for the charge transport solution will be discarded and replaced less frequently.

Example L

Additional prior art comparative examples and example photoconductors in accordance with the invention are set forth below.

Comparative Examples 9 and 10 are photoconductor drums comprising a prior art charge transport layer, while Examples 14–17 are photoconductor drums comprising charge transport layers in accordance with the invention.

Comparative Example 9

A standard 45/55 weight ratio mixture of type IV oxotitanium phthalocyanine (4.5 g) and polyvinylbutyral (5.5 g) in a mixture of 2-butanone/cyclohexanone (90/10) at 3% solids was used to coat an anodized aluminum drum and was dried at about 100° C. for about 15 min. Transport materials corresponding to bisphenol-A polycarbonate (Makrolon-5208, 31.15 g), and TPD (13.35 g) were dissolved in THF (133.5 g) and 1,4-dioxane (44.5 g), with a surfactant (DC-200, 3 drops). The anodized drum previously coated with a CG layer was dip-coated with the transport solution and was dried at 120° C. for 1 hour to obtain a coat weight of about 17.71 mg/in$^2$. The electrical characteristics of this drum were: charge voltage (Vo): −850V; voltage (0.21 $\mu$J/cm$^2$): −330V, voltage (0.42 $\mu$J/cm$^2$): −185V, residual voltage: −131V.

Example 14

A standard 45/55 weight ratio mixture of Type IV oxotitanium phthalocyanine (4.5 g) and polyvinylbutyral (5.5 g) in a mixture of 2-butanone/cyclohexanone (90/10) at 3% solids was used to coat an anodized aluminum drum and was dried at about 100° C. for about 15 min. Transport materials corresponding to bisphenol-A polycarbonate (Makrolon-5208, 28.04 g), poly(bisphenol-A-benzophenone-fluorenone azine) (Mn~14.8K, 3.11 g) and TPD (13.35 g), were dissolved in THF (133.5 g) and 1,4-dioxane (44.5 g), with a surfactant (DC-200, 3 drops). The anodized drum previously coated with a CG layer was dip-coated with the transport solution and was dried at 120° C. for about one hour to obtain a coat weight of about 16.91 mg/in$^2$. The electrical characteristics of this drum were: charge voltage (Vo): −850V; voltage (0.21 $\mu$J/cm$^2$): −343V, voltage (0.42 $\mu$J/cm$^2$): −192V, residual voltage: −136V.

Example 15

A standard 45/55 weight ratio mixture of Type IV oxotitanium phthalocyanine (4.5 g) and polyvinylbutyral (5.5 g) in a mixture of 2-butanone/cyclohexanone (90/10) at 3% solids was used to coat an anodized aluminum drum and was dried at about 100° C. for about 15 min. Transport materials corresponding to bisphenol-A polycarbonate (Makrolon-5208, 28.04 g), poly(fluorenylidene-bisphenol-A-benzophenone-fluorenone azine) (Mn~31.9K, 3.11 g) and TPD (13.35 g), were dissolved in THF (133.5 g) and 1,4-dioxane (44.5 g), with a surfactant (DC-200, 3 drops). The anodized drum previously coated with a CG layer was dip-coated with the transport solution and was dried at about 120° C. for about one hour to obtain a coat weight of about 16.85 mg/in$^2$. The electrical characteristics of this drum were: charge voltage (Vo): −846V; voltage (0.21 $\mu$J/cm$^2$): −345V, voltage (0.42 $\mu$J/cm$^2$): −207V, residual voltage: −149V.

Example 16

A standard weight ratio mixture of 45/55 Type IV oxotitanium phthalocyanine (4.5 g) and polyvinylbutyral (5.5 g) in a mixture of 2-butanone/cyclohexanone (90/10) at 3% solids was used to coat an anodized aluminum drum, and was cured at about 100° C. for about 15 min. Transport materials corresponding to bisphenol-A polycarbonate (Makrolon-5208, 28.04 g), poly(phenolphthaiein-benzophenone-fluorenone azine) (Mn~33.8K, 3.11 g) and TPD (13.35 g), were dissolved in THF (133.5 g) and 1,4-dioxane (44.5 g), with a surfactant (DC-200, 3 drops). The anodized drum previously coated with a CG layer was dip-coated with the transport solution and was dried at about 120° C. for about one hour to obtain a coat weight of about 16.93 mg/in$^2$. The electrical characteristics of this drum were: charge voltage (Vo): −851V; voltage (0.21 $\mu$J/cm$^2$): −363V, voltage (0.42 $\mu$J/cm$^2$): −207V, residual voltage: −140V.

Comparative Example 10

A standard 45/55 weight ratio mixture of Type IV oxotitanium phthalocyanine (4.5 g) and polyvinylbutyral (5.5 g) in a mixture of 2-butanone/cyclohexanone (90/10) at 3% solids was used to coat an anodized aluminum drum and was dried at about 100° C. for about 15 min. Transport materials corresponding to bisphenol-A polycarbonate (Makrolon-5208, 18 g), DEH (12 g) and Savinyl Yellow (0.20 g) were dissolved in THF (90 g) and 1,4-dioxane (30 g), with a surfactant (DC-200, 3 drops). The anodized drum previously coated with a CG layer was dip-coated with the transport solution and was dried at about 120° C. for about one hour to obtain a coat weight of about 17.48 mg/in$^2$. The electrical characteristics of this drum were: charge voltage (Vo): −850V; voltage (0.21 $\mu$J/cm$^2$): −361V, voltage (0.42 $\mu$J/cm$^2$): −194V, residual voltage: −150V.

Example 17

A standard 45/55 weight ratio mixture of Type IV oxotitanium phthalocyanine (4.5 g) and polyvinylbutyral (5.5 g) in a mixture of 2-butanone/cyclohexanone (90/10) at 3% solids was used to coat an anodized aluminum drum and was dried at about 100° C. for about 15 min. Transport materials corresponding to bisphenol-A polycarbonate (Makrolon-5208, 16.74 g), poly(cyclohexylidenebisphenol-benzophenone-fluorenone azine-bisphenol-A) (1.26 g), DEH (12 g) and Savinyl Yellow (0.20 g) were dissolved in THF (90 g) and 1,4-dioxane (30 g), with a surfactant (DC-200, 3 drops). The anodized drum previously coated with a CG layer was dip-coated with the transport solution and was dried at about 120° C. for about one hour. The electrical characteristics for a drum with coat weight of 12.63 mg/in$^2$ were: charge voltage (Vo): −848V; voltage (0.2 uJ/cm2): −381V, voltage (0.42 $\mu$J/cm$^2$): −236V, residual voltage: −186V. The electrical characteristics for a drum with coat weight of 28.52 mg/in$^2$ were: charge voltage (Vo): −849V; voltage (0.21 $\mu$J/cm$^2$): −387V, voltage (0.42 $\mu$J/cm$^2$): −217V, residual voltage: −159V.

PAPFAEs (Poly Aryl-perfluoroaryl Ether)s

Example M

PAPFAE polymerizations were carried out by the reaction of stoichiometric amounts of a bisphenol or a bisphenolate salt with decafluorobiphenyl in N,N-dimethylacetamide, at a temperature of about 120° C. The reactions were catalyzed by a base, either potassium carbonate or cesium fluoride. Two equivalents of the base was used with respect to the bisphenol or bisphenolate salt. All polymerizations were quenched in water, and the resulting product chopped in a high speed blender. The polymer was isolated by filtration, neutralized, and stirred in boiling water for about 1 hour, and then stirred in boiling methanol for about 1 hour. The white fibrous polymers were dried in a vacuum-oven at 100° C. for 16 hours. Near quantitative yields were obtained in all cases.

The polymers comprised the structure:

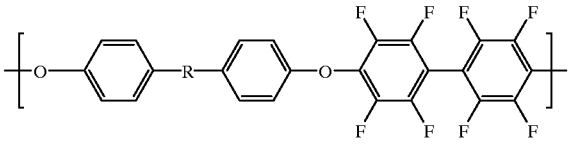

-continued where R = $C(CH_3)_2$; 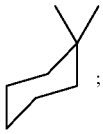 ; 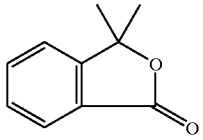 ; or

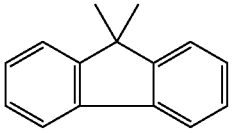

All polymers were soluble in tetrahydrofuran, chlorinated hydrocarbons (such as dichloromethane and chloroform), dioxane and polar aprotic solvents (such as dimethylacetamide and methyl sulfoxide). Characterizations of representative polymers are given in Table 18.

TABLE 18

Characterization of poly(aryl-perfluoroaryl ether)s

| R group | PAPFAE | Base | (° C.)/(h) | Mn | Mw | Polyd. | Tg (° C.) |
|---|---|---|---|---|---|---|---|
| Isopropylidene | P(BPA-PFBP) | $K_2CO_3$ | 120° C./2 h | 71707 | 566277 | 7.90 | 170 |
| Isopropylidene | P(BPA-PFBP) | CsF | 120° C./2 h | 25558 | 52757 | 2.06 | 160 |
| Cyclohexyli- | P(CYCLBP-PFBP) | CsF | 120° C./2 h | 20538 | 37219 | 1.81 | 172 |
| Fluorenylidene | P(FLUOBP-PFBP) | CsF | 120° C./3 h | 68862 | 219659 | 3.19 | 261 |

(° C.)/(h) = polymerization temperature/time; Mn = Number average molecular weight; Mw = Weight average molecular weight; Polyd. = Polydispersity; Tg = Glass transition temperature The reaction times were less than about 3 hours in all cases. In the case of potassium carbonate, the reaction time corresponds to the time following the azeotropic removal of water followed by removal of toluene. The glass-transition temperature of the polymers increased on introducing bulky cardo groups in the polymer backbone. Generally Tg of a fluorenylidene-containing backbone was greater than Tg of a cyclohexylidene-containing backbone which was greater than Tg of isopropylidene-containing backbone.

Several particular synthesis reactions are set forth below:

Poly(bisphenol-A-perfluorobiphenyl) (P(BPA-PFBP))

In a three neck 250 mL round-bottom flask was weighed bisphenol-A (6.0000 g, 26.28 mmol), potassium carbonate (7.264 g, 52.56 mmol), toluene (30 g) and N,N-dimethylacetamide (72 g). The flask was fitted with a Dean-Starke trap, a condenser and a thermometer. The mixture was stirred and heated to reflux. The water formed in the reaction was removed as water-toluene azeotrope. Following the removal of water, toluene was distilled. The reaction mixture was then cooled to about 60° C., and decafluorobiphenyl (8.7804 g, 26.28 mmol) was added to the mixture, which was then slowly heated to about 110° C. The solution was stirred for about 3 hours, and then precipitated in water. The off-white polymer was chopped in a high-speed blender, neutralized and filtered. The white polymer was stirred in boiling water for about 1 hour, filtered, and then stirred in boiling methanol for about 1 hour and filtered. The polymer was then dried in an vacuum oven for about 16 hours at 100° C. The yield was about 13.12 g. The number average molecular weight of the polymer was about 71.7K.

Poly(bisphenol-A-perfluorobiphenyl) (P(BPA-PFBP))

In a three neck 125 mL round-bottom flask was weighed bisphenol-A (4.0000 g, 17.52 mmol), cesium fluoride (5.323 g, 35.04 mmol), decafluorobiphenyl (5.8541 g, 17.52 mmol) and N,N-dimethylacetamide (46 g). The flask was fitted with a condenser and a thermometer. The yellow mixture was stirred and heated to about 120–123° C. The solution was stirred for about 2 hours, and then precipitated in water. The off-white polymer was chopped in a high-speed blender, neutralized with 10% aqueous sodium hydroxide solution and filtered. The white polymer was stirred in boiling water for about 1 hour, filtered, and then stirred in boiling methanol for about 1 hour and filtered. The fibrous white polymer was then dried in an vacuum oven for about 16 hours at about 100° C. The yield was about 9.02 g. The number average molecular weight of the polymer was about 25.5K.

Poly(cyclohexylidenebisphenol-perfluorobiphenyl) (P(CYCLBP-PFBP))

In a three neck 125 mL round-bottom flask was weighed 1,1-cyclohexylidenebisphenol (5.0000 g, 18.63 mmol), cesium fluoride (5.660 g, 37.26 mmol), decafluorobiphenyl (6.2252 g, 18.63 mmol) and N,N-dimethylacetamide (53 g). The flask was fitted with a condenser and a thermometer. The light orange mixture was stirred and heated to about 120° C. The solution was stirred for about 2 hours, and then precipitated in water. The white polymer was chopped in a high-speed blender, neutralized with 10% aqueous sodium hydroxide solution and filtered. The white polymer was stirred in boiling water for about 1 hour, filtered, and then stirred in boiling methanol for about 1 hour and filtered. The fibrous white polymer was then dried in an vacuum oven for about 16 hours at about 100° C. The yield was about 9.98 g. The number average molecular weight of the polymer was about 20.5K.

Poly(fluorenylidenebisphenol-perfluorobiphenyl) (P (FLUOBP-PFBP))

In a three neck 125 mL round-bottom flask was weighed 9,9-fluorenylidenebisphenol (4.0000 g, 11.41 mmol), cesium fluoride (3.4679 g, 22.82 mmol), decafluorobiphenyl (3.8139 g, 11.41 mmol) and N,N-dimethylacetamide (37 g). The flask was fitted with a condenser and a thermometer. The light orange mixture was stirred and heated to about 120° C. The solution was stirred for about 3 hours, and then precipitated in water. The work-up was similar to that of the previous examples. The yield was about 7.15 g. The number average molecular weight of the polymer was about 68.8K.

Example N

Charge transport solutions comprising a polycarbonate, a PAPFAE and a charge transport molecule were prepared. Unlike polytetrafluoroethylene systems, the perfluoroarylpolymers are soluble and were dissolved in the transport solution, following the addition of polycarbonate. Generally the solutions appeared nearly homogeneous and clear. However, at the 25% perfluoropolymer level, the solutions were slightly translucent. Charge transport layers comprising N,N'-bis(3-methylphenyl)-N,N'-bisphenylbenzidine (TPD) in a mixture of polycarbonate-A and a perfluoroarylpolymer were coated on a type IV TiOPc/BX-55Z polyvinylbutyral charge generation layer, and the results are summarized in Table 19.

TABLE 19

Initial electricals for drums having CTL containing TPD in a PAPFAE/PC-A binder blend (Expose-to-develop time of 76 ms, using a 780 nm laser)

| % TiOPc | R group | Mn | PC-A/ PAPFAE | Charge Voltage (−Vo) | Residual voltage (−Vr) | $V_{0.22\mu J/cm^2}$ |
|---|---|---|---|---|---|---|
| 35 | Nil | Nil | 100/0 | 850 | 180 | 372 |
| 35 | Isopropylidene | 71,707 | 75/25 | 849 | 353 | 485 |
| 45 | Nil | Nil | 100/0 | 851 | 95 | 314 |
| 45 | Isopropylidene | 71707 | 95/5 | 851 | 133 | 299 |
| 45 | Isopropylidene | 25558 | 95/5 | 849 | 139 | 332 |
| 45 | Cyclohexylidene | 20538 | 95/5 | 851 | 101 | 301 |
| 45 | Fluorenylidene | 68862 | 95/5 | 846 | 113 | 268 |

$V_{0.22\mu J/cm^2}$ = Voltage at 0.22 $\mu J/cm^2$

Preferred PAPFAE polymers comprise cyclohexylidene and/or fluorenylidene groups. Generally the mixture of polycarbonate and PAPFAE comprises less then 25% PAPFAE, by weight of total mixture. The charge transport solutions preferably comprise a blend of a polycarbonate and a PAPFAE in a weight ratio of about 95:5.

As a means of comparing the soluble PAPFAE of the present invention to a liquid prior art perfluoropolymer system, Fomblin Z-Dol (poly(perfluoropropylene oxide-co-perfluoroformaldehyde, Mn~6600) was dispersed in the charge transport layer consisting of TPD and PC-A. The fluoropolymer was used at 1% and 5% levels. Table 20, set forth below, illustrates the effect of the fluoropolymer systems on the electricals characteristics of a photoconductor drum.

TABLE 20

Effect of fluoropolymers on the initial electricals of drums (expose-to-develop time of 76 ms, 780 nm laser)

| % TPD | % PCA | Fluoropolymer | Charge Voltage (−Vo) | Residual voltage (−Vr) | $V_{0.22\mu J/cm^2}$ | Coating quality |
|---|---|---|---|---|---|---|
| 30 | 70 | Nil | 851 | 95 | 314 | Good |
| 30 | 69 | 1% Fomblin Z-Dol | 853 | 345 | 432 | Poor |
| 30 | 65 | 5% Fomblin Z-Dol | 849 | 456 | 506 | Poor |
| 30 | 65 | 5% P(BPA-PFBP) | 849 | 139 | 332 | Good |

$V_{0.22\mu J/cm^2}$ = Voltage at 0.22 $\mu J/cm^2$

Although the prior art liquid perfluoropolyether dispersed easily in the transport solution, the resulting photoconductor shows higher residual voltage, even at low fluoropolymer loading. The prior art perfluoroploymer-based coating on the drum exhibited droops, and was not uniform. In contrast, the use of P(BPA-PFBP), a PAPFAE in accordance with the invention, resulted in good coating quality without significant adverse effects on the electrical characteristics of the drum.

Example O

The photoconductor drum containing the isopropylidene based perfluoropolymer (Mn~71K, 5%) in the CTL was evaluated for life in an Optra-S printer. The results from this experiment are set forth below in Table 21.

TABLE 21

Life-test results of drums having a CTL containing perfluoroarylpolymers (P(BPA-PFBP)) blend and 30% TPD

| % TiOPc | R group | Charge/ Discharge at SOL | Charge/ Discharge at EOL | Residual voltage at SOL/EOL | Streak page voltage SOL/EOL | Onset of Drum End-Wear |
|---|---|---|---|---|---|---|
| 45 | Nil | 100/0 | 850/820 | 118/148 | 530/374 | 12K |
| 45 | Isopropylidene | 95/5 | 859/892 | 186/223 | 534/586 | 20K |

SOL: Start of life; EOL: End of life (about 30,000 prints)

The incorporation of the soluble PAPFAE in the transport layer improves the drum-end wear. The PAPFAE has a significant effect even at 5% loading (with respect to the binder), this corresponds to about 3.5% of all solids in the CTL. The print-quality appears to be stable over life. This is evidenced by the severe positive fatigue observed in the case of the control drum (PC-A), with the streak page voltage changing by about 150V. This causes more toner to be deposited on the print-page, whereby the graphics become dark with life. However, the PAPFAE system shows a nominal 50V fatigue, and nearly stays constant through life, thereby resulting in a stable print-quality. Whereas the control drum exhibited onset of drum-end wear at about 12,000 prints, the PAPFAE drum was relatively more wear resistant; some drum end-wear was observed at about 20,000 prints, a 40% improvement in the wear.

Another advantage observed using the PAPFAE as a blend with the polycarbonate, in particular PC-A, is the improvement in pot-life of the transport solution. The pot-life of a transport solution containing PC-A and TPD (70/30 w/w) is about a week, after which the solution gels. However, on adding about 5% of the PAPFAE (with respect to the PC-A), the pot-life was found to increase at least about 2-fold, preferably at least about 3-fold. This relates to a significant cost-savings when using PC-A containing solutions.

Example P

Additional prior art comparative examples and example photoconductors in accordance with the invention are set forth below.

Comparative Example 11 is a photoconductor drum comprising a prior art charge transport layer, while Examples 18–21 are photoconductor drums comprising charge transport layers in accordance with the invention.

Comparative Example 11

A charge generation formulation consisting of a 45/55 pigment/binder ratio was prepared as follows.

Oxotitanium phthalocyanine (2.16 g, Type-IV), polyvinylbutyral (BX-55Z, Sekisui Chemical Co., 2.64 g) with Potter's glass beads (20 ml) was added to 2-butanone (20 g) and cyclohexanone (15.5 g), in an amber glass bottle, and agitated in a paint-shaker for about 12 hours and diluted to about 3% solids with 2-butanone (119.6 g). An anodized aluminum drum was then dip-coated with the CG formulation and dried at 100° C. for 5 min. The transport layer formulation was prepared by a dissolving a bisphenol-A polycarbonate (MAK-5208, Bayer, 62.30 g), benzidine (26.70 g) in tetrahydrofuran (THF, 249 g) and 1,4-dioxane (106 g). The CG layer coated drum was dip-coated with the CT formulation and dried at about 120° C. for about 1 hour to obtain a coat weight of about 16.80 mg/in$^2$. The electrical characteristics of this drum were: charge voltage (Vo): −848V, residual voltage (Vr): −95V (OD: 1.63).

Example 18

The charge generation formulation used in Comparative Example 11 was used to coat an anodized aluminum drum, and was dried at about 100° C. for about 5 min. The transport layer formulation was prepared by dissolving bisphenol-A polycarbonate (19.0 g), poly(bisphenol-A-perfluorobiphenyl) (P(BPA-PFBP), Mn~70.7K, 1.0 g) and TPD (8.57 g) in a mixture of THF (97.6 g) and dioxane (32.5 g), along with a surfactant (DC-200, 3 drops). The CT solution was coated on the CGL to obtain a coat weight of about 17.25 mg/in$^2$. The electrical characteristics of this drum were: charge voltage (Vo): −850V, residual voltage (Vr): −133V (OD: 1.63).

Example 19

The charge generation formulation used Comparative Example 11 was used to coat an anodized aluminum drum, and was dried at about 100° C. for about 5 min. The transport layer formulation was prepared by dissolving bisphenol-A polycarbonate (19.0 g), poly(bisphenol-A-perfluorobiphenyl) (P(BPA-PFBP), Mn~25.5K, 1.0 g) and TPD (8.57 g) in a mixture of THF (97.6 g) and dioxane (32.5 g), along with a surfactant (DC-200, 3 drops). The CT solution was coated on the CGL to obtain a coat weight of about 17.40 mg/in$^2$. The electrical characteristics of this drum were: charge voltage (Vo): −849V, residual voltage (Vr): −139V (OD: 1.51).

Example 20

The charge generation formulation used in Comparative Example 11 was used to coat an anodized alumina drum, and was dried at about 100° C. for about 5 min. The transport layer formulation was prepared by dissolving bisphenol-A polycarbonate (19.0 g), poly(cyclohexylidenebisphenol-perfluorobiphenyl) (P(CYCLBP-PFBP), Mn~20.8K, 1.0 g) and TPD (8.57 g) in a mixture of THF (97.6 g) and 1,4-dioxane (32.5 g), along with a surfactant (DC-200, 3 drops). The CT solution was coated on the CGL to obtain a coat weight of about 15.80 mg/in$^2$. The electrical characteristics of this drum were: charge voltage (Vo): −851V, residual voltage (Vr): −101V (OD: 1.63).

Example 21

The charge generation formulation used in Comparative Example 11 was used to coat an anodized alumina drum, and was dried at about 100° C. for about 5 min. The transport layer formulation bisphenol-A polycarbonate (19.0 g), poly (fluorenylidenebisphenol-perfluorobiphenyl) (P(FLUOBP-PFBP), Mn~68.8K, 1.0 g) and TPD (8.57 g) in a mixture of THF (97.6 g) and 1,4-dioxane (32.5 g), along with a surfactant (DC-200, 3 drops). The CT solution was coated on the CGL to obtain a coat weight of about 17.50 mg/in$^2$. The electrical characteristics of this drum were: charge voltage (Vo): −846V, residual voltage (Vr): −113V (OD: 1.63).

Additional embodiments and modifications within the scope of the claimed invention will be apparent to one of ordinary skill in the art. Accordingly, the scope of the present invention shall be considered in the terms of the following claims, and is understood not to be limited to the details or the methods described in the specification.

What is claimed is:

1. A method of extending the pot-life of a charge transport composition, comprising the step of providing a polyaryl ether selected from the group consisting of polyaryletherketones, poly(aryl-perfluoroaryl ether)s, polyaryletherketone-hydrazones, polyaryletherketone-azines and mixtures and copolymers thereof in combination with a polycarbonate and a charge transport molecule.

2. A method according to claim 1, wherein the weight ratio of polycarbonate to polyaryl ether is from about 93:7 to about 85:15.

3. A method according to claim 1, wherein the polyaryl ether is synthesized from a bisphenol compound selected from the group consisting of bisphenol-A, cyclohexylidenebiphenol, fluorenylidenebisphenol, phenolphthalein, methylbisphenol-A, bisphenolate salts and mixtures thereof.

4. A method according to claim 3, wherein the polyaryl ether is synthesized from two different bisphenol compounds.

5. A method according to claim 1, wherein the polycarbonate comprises polycarbonate A.

6. A charge transport composition comprising a charge transport molecule, solvent and a binder blend, wherein the binder blend comprises polycarbonate and polyaryl ether selected from the group consisting of polyaryletherketones, poly(aryl-perfluoroaryl ether)s, polyaryletherketone-hydrazones, polyaryletherketone-azines and mixtures and copolymers thereof.

7. A charge transport composition according to claim 6, wherein the polycarbonate comprises polycarbonate A.

8. A charge transport composition according to claim 7, comprising, by weight, from about 10% to about 15% polycarbonate A and from about 0.5% to 15% polyaryl ether.

9. A charge transport composition according to claim 8, wherein the weight ratio of polycarbonate A to polyaryl ether is from about 93:7 to about 85:15.

* * * * *